United States Patent [19]

Casull

[11] Patent Number: 5,050,324

[45] Date of Patent: Sep. 24, 1991

[54] ARTISTIC DISPLAYS OF TEMPORARILY STORED AUDIO RECORDINGS, AND METHODS

[75] Inventor: Steven J. Casull, Salt Lake City, Utah

[73] Assignee: J. Frames International, Ltd., Draper, Utah

[21] Appl. No.: 518,006

[22] Filed: May 2, 1990

Related U.S. Application Data

[63] Continuation-in-part of Ser. No. 306,968, Feb. 2, 1989, abandoned.

[51] Int. Cl.[5] ..... G09F 1/12

[52] U.S. Cl. ..... 40/152; 40/152.1; 40/611; 16/364

[58] Field of Search ..... 40/152, 152.1, 155, 40/156, 611; 312/322, 323; 403/100, 401, 402; 16/362, 363, 364

[56] References Cited

U.S. PATENT DOCUMENTS

| | | | |
|---|---|---|---|
| 272,717 | 2/1883 | Lewis | 40/156 |
| 1,256,518 | 2/1918 | Carlon | 40/156 |
| 1,411,908 | 4/1922 | Cacici | 40/156 |
| 1,470,856 | 10/1923 | Lundberg | 40/152 |
| 3,065,943 | 11/1962 | Hull | 40/152.1 |
| 3,590,510 | 7/1971 | Salz | 40/155 |
| 3,883,974 | 5/1975 | Ashton | 40/152 |
| 4,258,488 | 3/1981 | Schienbein | 40/152 |
| 4,258,967 | 3/1981 | Bondreau | 312/322 |
| 4,261,122 | 4/1981 | LeVine | 40/152 |
| 4,403,434 | 9/1983 | Jenkins | 40/152 |
| 4,571,866 | 2/1986 | Cole et al. | 40/152.1 |
| 4,726,133 | 2/1988 | Rainone et al. | 40/155 |
| 4,778,228 | 10/1988 | Ackeret | 312/323 |

FOREIGN PATENT DOCUMENTS

| | | | |
|---|---|---|---|
| 211636 | 11/1957 | Australia | 40/152.1 |
| 26535 | 6/1883 | Fed. Rep. of Germany | 403/402 |
| 2406439 | 8/1975 | Fed. Rep. of Germany | 16/364 |
| 2933838 | 9/1981 | Fed. Rep. of Germany | 40/152 |
| 2160347 | 12/1985 | United Kingdom | 40/152.1 |
| 2183996 | 6/1987 | United Kingdom | 312/322 |

*Primary Examiner*—Peter R. Brown
*Assistant Examiner*—Brian K. Green
*Attorney, Agent, or Firm*—Lynn G. Foster

[57] ABSTRACT

A display frame for visually exposing, during times of storage, the artwork of an album cover in which an audio recording is sold. The display frame is equipped with a quick response access frame gate manually movable between closed and open positions for respectively containing and accommodating rapid insertion, removal or exchange of an album cover, with or without the audio recording contained therein.

20 Claims, 10 Drawing Sheets

ARTISTIC DISPLAYS OF TEMPORARILY STORED AUDIO RECORDINGS, AND METHODS

CONTINUATION

This application is a continuation-in-part of my pending U.S. patent application Ser. No. 306,968, filed Feb. 2, 1989, now abandoned.

FIELD OF THE INVENTION

The present invention relates generally to the storage and display of art used in conjunction with sound recording, and more specifically to novel wall and pedestal frames in which standard long-playing (LP) albums, compact disks and covers, jackets or long-term packages may be safely, efficiently and easily accessibly displayed as an art form. The invention also specifically relates to novel frame connecting or corner mechanisms by which frame members are interconnected so that at least one biased frame member can be selectively manually opened, held open, and closed.

Prior Art

The audio recording industry is one of the largest entertainment-related industries, with total worldwide LP (long playing) record sales in 1985 of approximately 730 million units with a value of approximately $12.25 billion. Recently, sales of compact disks have resulted in a very large market as well. Audio cassette tapes has long been a significant market also. While the audio portion of the LP records perhaps has been the most widely recognized and sought after expression of musical art, the design of record album covers or jackets, and containers and packaging for other types of audio recordings has in recent years become a viable and increasingly popular visual art form, in and of itself. It is not uncommon for audio record production companies to spend as much as $300,000.00 in creating the artwork used on one album cover. The resulting art is regarded as being both high quality and visually attractive.

The display art associated with the covers or containers of audio recordings has gained significantly among the younger generation, comprising those under 30 years of age, which accounts for approximately 70% of all LP sales in the United States. Music is an important part of many youth cultures and often comprises a part of the latest musical trends, often playing a significant role in determining a young person's social status among his or her peers. Following the latest musical trends includes not only owning the most recent and most popular LP or like record releases, but also as being seen by others to own and be informed of the same. Since record jackets (album covers) and the like are the most visible identification of the audio recording and its audio recording artist, attractive display of the record jacket is desirable.

Though many picture framing apparatus and methods are available in prior art, most are not well adapted to presentation, storage and access of audio covers or containers. Often when picture frames are used, substantial time and effort are required to insert or remove a record jacket into and from such a picture frame, which is generally not designed for ready interchangeability of its contents. Also, when an LP jacket or the like is mounted inside a regular picture frame, the installer is often forced to gather specific tools or go through an arduous frame disassembly process each time he or she desires to listen to the record disposed in the framed jacket. If the record is stored separately from the jacket, the record becomes subject to inadvertent breakage and the unwanted effects of dust, scratches, etc. Audio covers and containers require special handling and access, since the material is not meant to remain in display as would a picture, but rather the audio contents need to be readily accessible for use and bending and folding can effect permanent damage to audio recording media.

Also, wear and tear on the picture frame, due to repeated assembly and disassembly, can materially shorten the useful life of the picture frame. Even so, recognizing the similarities in application between storage of art for presentation and storage and access of audio material, the following prior art description comprises picture frame material.

Australian Patent 211,636 teaches a frameless structure comprising plurality of clips placed on the periphery of glass sheets and resiliently interconnected by biasing springs to constrain the clips firmly against the edges of the glass sheets to form a picture frame. Visual material, such as a picture, can be placed between glass sheets. While this approach allows disassembly without tools, one or more of the clips must be removed to relieve the spring tension from the assembly and provide access to the visual material between the glass sheets. Removal of the clips may lead to inadvertent disassembly and require extensive reassembly each time a visual insert is replaced between the glass plates. The risks of personal injury and glass breakage is high by reason of the above-stated requirement for substantial manual handling.

Similar to Australian Patent Specification 211,636, U.S. Pat. No. 3,590,510 teaches that "a mirror, picture or similar flat article of rectangular outline is positively gripped on at least one pair of opposite sides by two brackets with beveled flanges drawn toward each other by clamps and/or springs." The same problems mentioned above in respect to Australian Patent 211,636 regarding disassembly and assembly, when accessing contents, applies to this patent.

In U.S. Pat. No. 3,065,943, "unique means . . . for holding the movable side or lid in position when the frame is closed and at the same time enabling ready opening of the lid to gain access to the interior of the case for insertion, changing, or removal of the articles stored or displayed therein" is disclosed. This patent discloses a hinged edge which is restrained by elastic cords to urge closure of the edge after being manually opened. It also discloses a slot through which an eye fastener on the hinged edge coacts to lock the hinged edge in its closed position and other means for holding the hinged lid in place after closure. Thus, the elastically restraining members are admitted to be inadequate to hold the hinged lid closed after having been opened.

A hinged frame edge generally similar to the one disclosed in U.S. Pat. No. 3,065,943, but comprising magnetic retention, is disclosed in U.S. Pat. No. 4,261,122 in respect to a storage and security frame assembly. For access, the edge is shown to be rotated 90 degrees about a ribbon hinge for access to contents of the frame device.

A three cross member frame for mounting a picture wherein one edge or frame member is displaceable from the other to accommodate removal or slidably demounting for access to the contents of the frame is described in U.S. Pat. No. 3,883,974. This patent discloses first manual rectilinear translation of the movable frame member followed by physically prying the extended frame member out of the plane containing the remainder of the frame such that a picture or the like is removed and/or replaced. However, access to visual material within a frame in this manner is not desirable. Insertion or removal requires application of flexure or bending of either the straight portions of the springs or the material being inserted. Such bending can also damage any sound recording disposed within the visual material.

Similar spring biased edge extending access structure which moves rectilinearly is disclosed in U.S. Pat. No. 1,470,856, wherein a card holder is adapted to slide outward with the edge and also produces the flexure or bending problem just related.

A frame which slidably receives one edge frame member in place using linear guides or frame inserts wherein the one edge is linearly removed from the remainder of the frame for access is described in U.K. Patent Application G.B. 2,160,347A.

Corner connectors for frame members are disclosed in U.S. Pat. No. 4,403,434 and German Patent 2,293,838. The U.S. patent discloses corner connectors, affixed to edge frame members, comprising peripherally cam apertures. Cam operating buttons are placed in the apertures and a quarter turn locks or unlocks each connection to and from the associated frame member. The German Patent discloses corners held together by diagonally disposed biased springs which pull the corners together. In both of these patents, access is accomplished through disassembly of at least two corners making regular access difficult and time consuming.

U.S. Pat. No. 4,258,588 teaches a single piece, vacuum formed frame of synthetic resinous material, which provides direct frontal access to an exposed phonograph record album cover. Thus, the album cover is open to dust and other environmental particles, which can be harmful to any sound recording within the cover. The album cover rests in a slot between ridges and leans against adhesive tabs 22.

A frame mechanism for mounting a display item on a vertical support surface is disclosed in U.S. Pat. No. 4,571,866. Static corner pieces are disclosed. A static hangar portion of one mounting frame member defines a serrated edge which facilitates level hanging of the frame assembly by providing a plurality of notches for selective engagement with a supporting appendage.

BRIEF SUMMARY AND OBJECTS OF THE INVENTION

In brief summary, the present invention overcomes or substantially alleviates the problems associated with the aforesaid prior art. The invention is directed primarily toward dynamic corner mechanisms and a display frame for visually exposing, on an accessible basis, the packaging in which audio or sound recordings are sold and thereafter stored. The display frame is equipped with an access frame gate which can be manually located to releasably lock into either a closed or an open position for containment of the packaging in the closed position and accommodating insertion and removal of the packaging with or without the audio recording contained therein.

With the foregoing in mind, it is a principal object of the present invention to overcome or substantially alleviate the aforesaid problems of the prior art and to provide a novel display and storage frame comprising and ingress and egress access gate for insertion, removal and replacement of the jackets of LP and/or storage packaging of other audio recordings, and related methods.

Another important object is to provide a novel display and storage frame whereby the contents displayed or to be displayed can be readily manually removed, inserted and replaced, without the use of tools.

It is a primary object to provide novel corner mechanisms used to attach frame members together to form a display and storage frame comprising at least one quick release access frame gate which is manually movable between two stable states which comprise open and closed positions to allow facile ingress, egress and exchange of art objects.

It is a foremost object to provide a frame edge for a display and storage frame comprising novel corner mechanisms by which other edge frame members of a storage frame can be attached to form a complete frame comprising a quick release access frame gate.

A further significant object is the provision of a novel display and storage frame comprising a quick release access frame gate manually movable between two stable states which comprise biased closed and open positions to allow facile ingress, egress and exchange of art objects to be displayed.

A further principal object of this invention is to provide a storage and display frame which displays the packaging or covers of audio recordings, with or without the sound recording therein.

It is a further dominant object to provide stylish display frames whereby collectors of LPs and other audio recordings may decoratively display the artwork of album and other coverings of audio recordings and may rapidly and easily change the make-up of the display from time-to-time as desired.

These and other objects and features of the present invention will be apparent from the detailed description taken with reference to the accompanying drawings.

DETAILED DESCRIPTION OF THE ILLUSTRATED EMBODIMENTS

Figure 6:
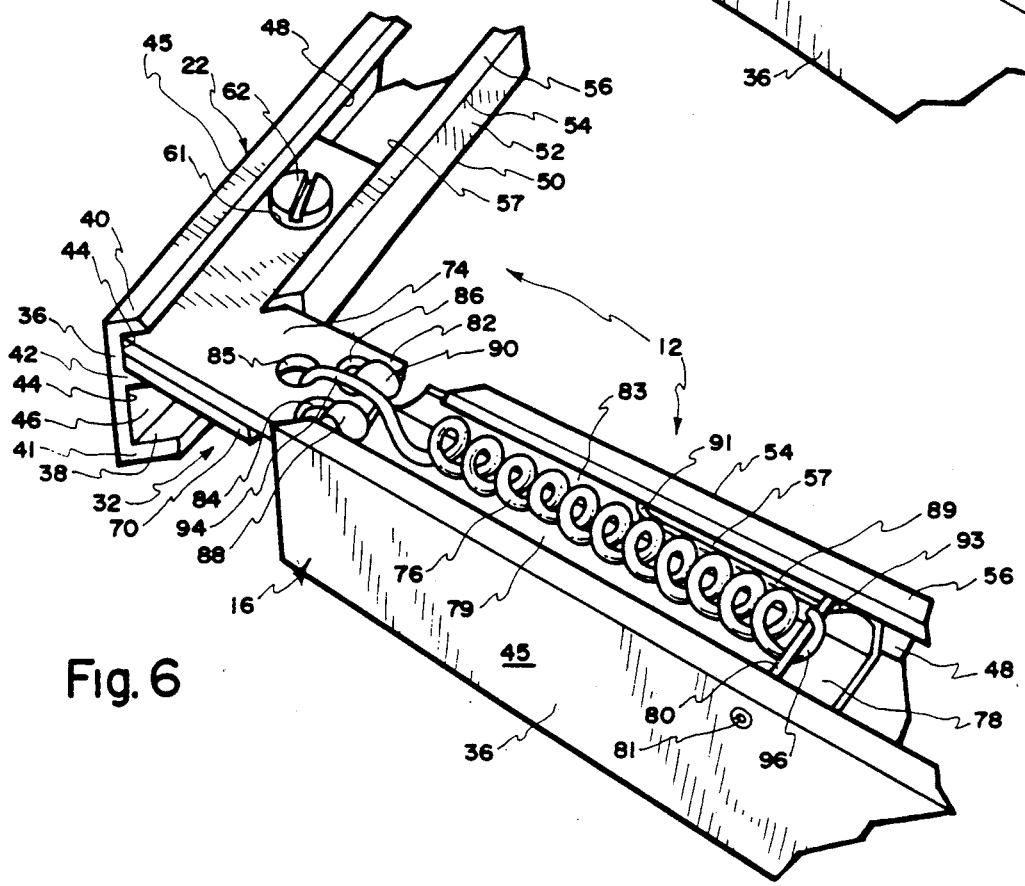
FIG. 6 is an enlarged fragmentary perspective view of the lower left corner of the access frame gate illustrated in FIG. 2, showing the access gate in its rectilinearly extended position.
Figure 7:
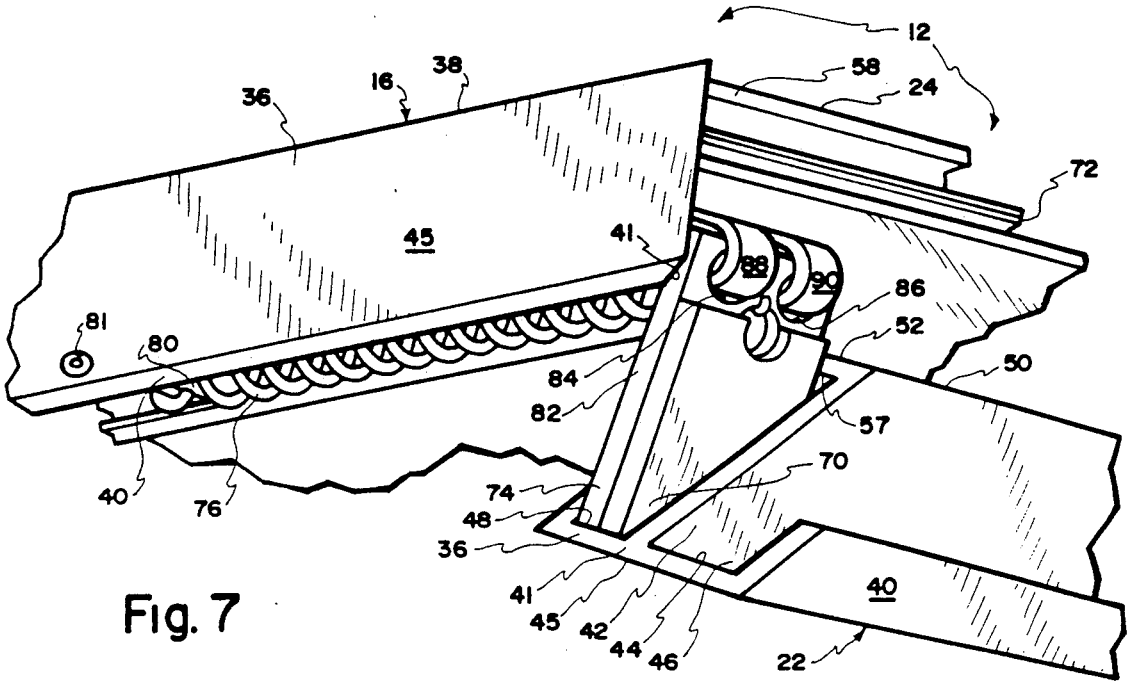
FIG. 7 is an enlarged reverse angle fragmentary perspective view of the lower left corner of the access frame gate illustrated in FIG. 2, showing the access gate in its fully rectilinearly extended and fully rotated open position.
Figure 8:
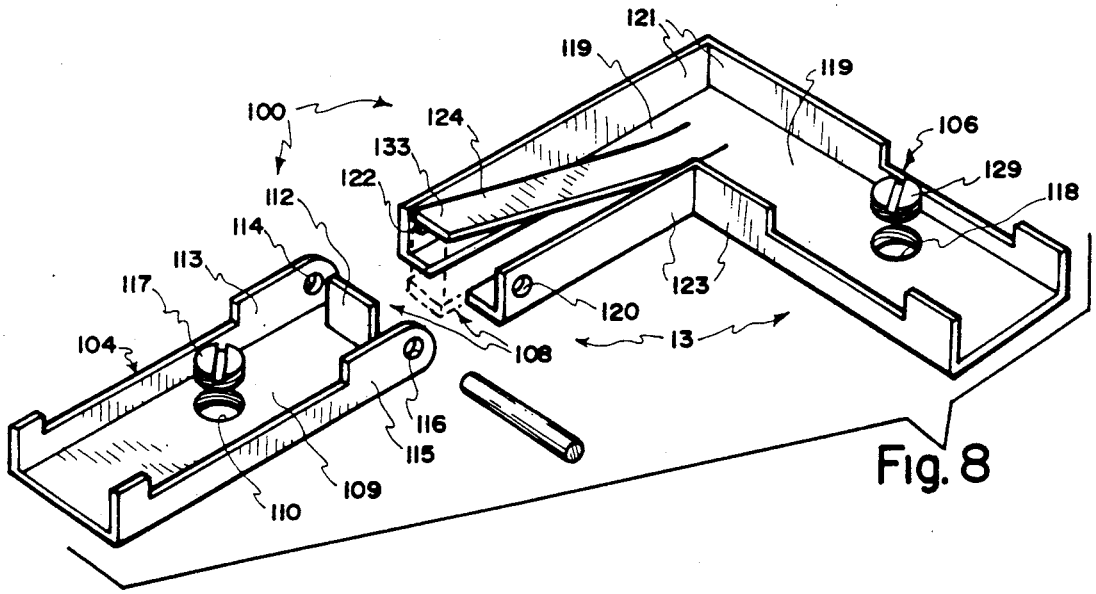
FIG. 8 is an exploded perspective view of a second presently preferred movable connector used in conjunction with an access frame gate.
Figure 9:
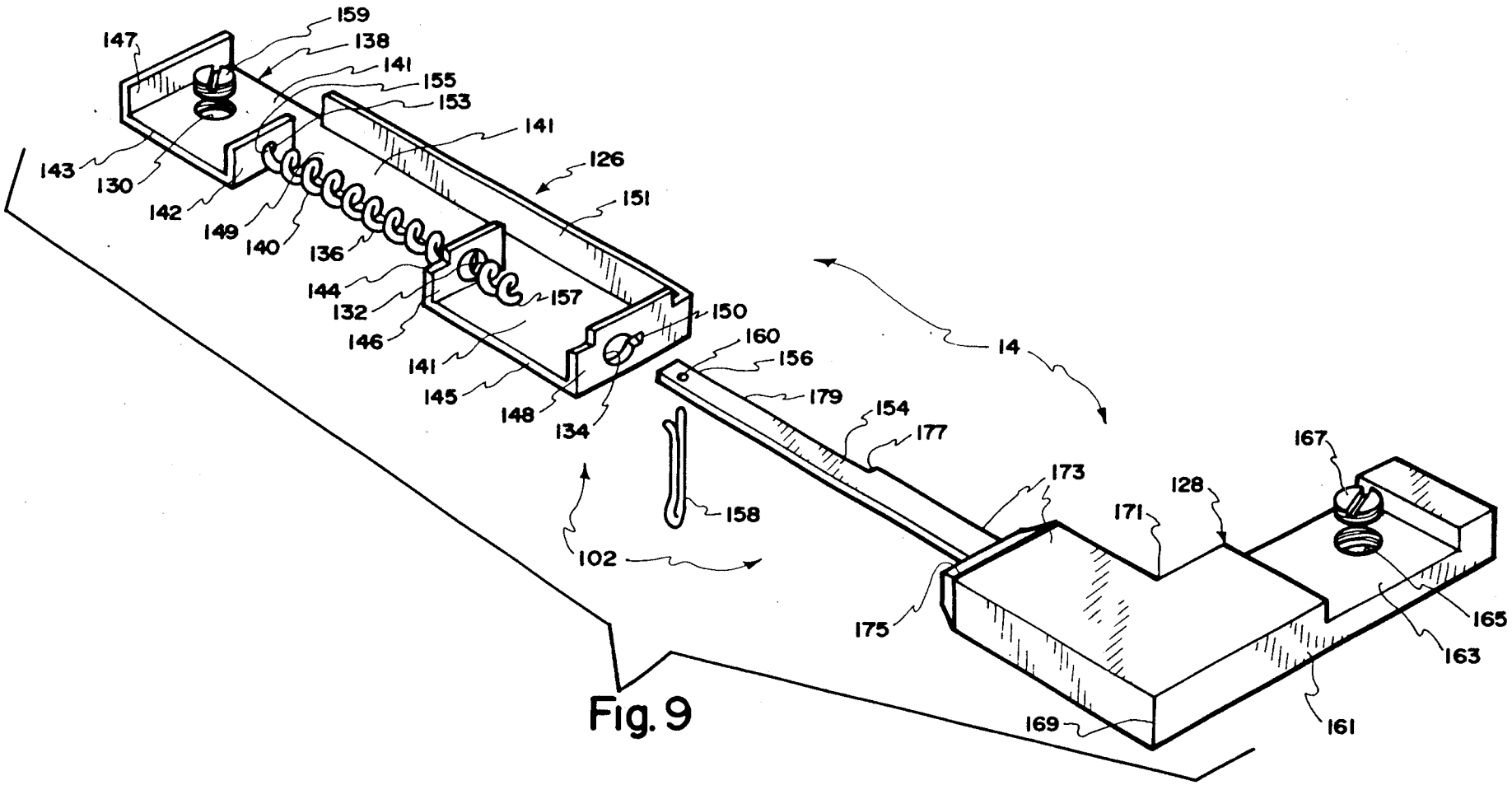
FIG. 9 is an exploded perspective view of a third presently preferred movable connector used in conjunction with an access frame gate structure.

Reference is now made to the drawings, wherein like numerals are used to describe like parts throughout. Specific reference is made to FIGS. 1-7, which illustrates one presently preferred display assembly embodiment of the present invention shown in its static display position suspended upon a wall. The display assembly of FIGS. 1-7 is generally designated 10. Two other presently preferred embodiments, shown in FIGS. 8 and 9, are hereinafter described in greater detail. FIGS. 11-14 show a fourth presently preferred embodiment which is also discussed later in detail. FIGS. 15 through 20 depict still another presently preferred embodiment of this invention. The embodiments of FIGS. 11 through 20 are particularly adapted for use in displaying the packaging of a compact disc sound recording.

Figure 2:
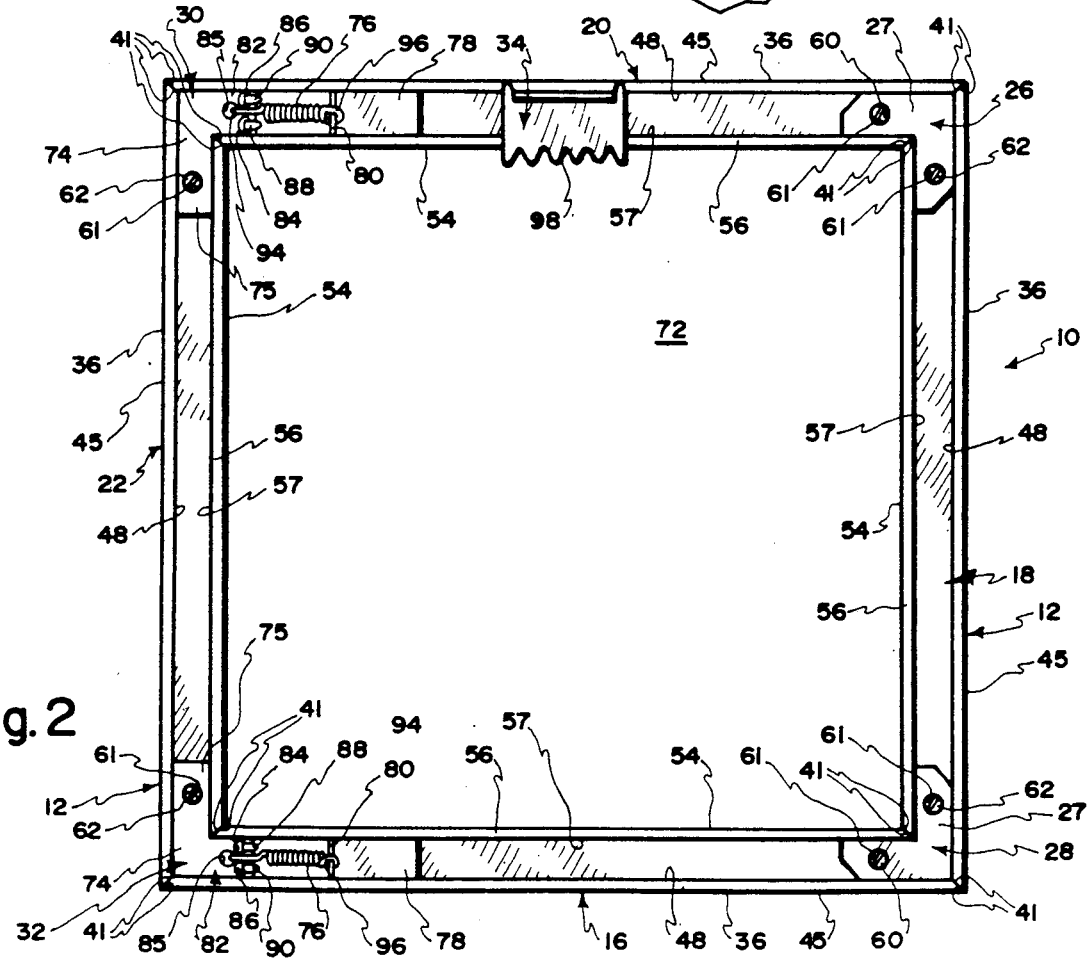
FIG. 2 is an enlarged rear elevational view of the frame of FIG. 1, illustrating a presently preferred access frame gate in its closed position.

The display assembly 10 comprises a frame 12, which is illustrated in FIG. 2 as being frontally square and having a relatively thin front-to-rear depth. However, it is recognized that several different shapes, sizes and thicknesses fall within the scope of the present invention. Frame 12 is generally planar and thus accommodates insertion and removal of one or more jackets or covers 72 for a LP record and the like, with or without the record therein.

The frame 12 is illustrated as comprising four linear edge frame members, generally designated 16, 18, 20 and 22 and a protective front window 24, which encloses but visually exposes the artwork 73 of the record jacket 72. The frame 12 also comprises flat angular rigid corner connectors or rigid frame corner means, generally designated 26 and 28, two access gate mechanisms or movable corner means, generally designated 30 and 32, and a standard hanging device, generally designated 34, used to releasibly suspend the frame 12 to a wall or the like. While window 24 and hanging device 34 are illustrated, they are optional. For example, the window can be eliminated and a desk-top stand can be used in lieu of the hanging device.

The edge frame members 16, 18, 20 and 22 are virtually identical to each other and thus only one needs to be structurally described. Each edge frame member 16, 18, 20 and 22 may be fabricated from steel, aluminum, rigid plastic or other suitable rigid shape-retaining material. The members 16, 18, 20 and 22 may be extruded, molded or otherwise formed. In the illustrated configuration seen in FIGS. 3, 4, 13 and 14, each of the frame members 16, 18, 20 and 22 are shown as having a somewhat E-shaped cross-section. Of course other cross-sectional configurations may be used. The structural features of the frame members are not critical to the present invention.

Viewed in cross-section, each frame member 16, 18, 20 and 22 comprises an exteriorly exposed base wall 36, illustrated as being of uniform thickness and comprising spaced interior surface locations 44 and an exposed exterior surface 45. See FIGS. 3-6. The proximal ends of a front exposed flange 38, a bottom flange 40, and a circuitously-shaped central flange 42 each integrally merge with the base wall 36 of each frame member 16, 18, 20 and 22. As shown, the flanges 38, 40 and 42 each extend parallel to each other away from their respective integral unions with base wall 36, are respectively disposed at right angles to and extend inwardly from the interior side 44 of base 36. Flanges 38, 40 and 42 are shown as being of the same uniform thickness. Collectively, the base wall 36 and flanges 38 and 42 of each member 16, 18, 20 and 22 define a U-shaped groove 46. Similarly, the base wall 36 and flanges 40 and 42 of each member 16, 18, 20 and 22 collectively form a second smaller U-shaped groove 48, disposed adjacent to and parallel with groove 46. Each groove 46 is somewhat larger and wider than the associated parallel groove 48 and is used to receive and hold the edges of the jacket 72 in place within the frame 12. Flange 42, which extends linearly a lateral distance greater than associated flanges 38 and 40. Flange 42, at its farthest point from base wall 36 merges through 90° at 50 with inside frame flat wall 52. In turn wall 52 reverse merges through 90° at 54 with outwardly directed lip 56, which is disposed within the plane containing flange 40. The space confined between lip 56, wall 52 and flange 42 defines a groove 57, which is aligned with and a mirror image of groove 48. Grooves 48 and 57 of three of the four frame members receive one leg portion of L shaped connectors 26 and 28 at two of the four corners of the frame. Displacement mechanisms 30 and 32 are disposed at the other two corners, as hereinafter described in greater detail.

As shown in FIGS. 1-7, each of the frame members 16, 18, 20 and 22 terminates at each end in a 45 diagonal end edge 41 such that when the frame members are assembled in a diagonal end-to-end fashion a square or rectangle is formed.

The window 24 is of suitable light-transmitting material, such as glass or transparent plastic, and conforms in shape with the interior of the frame 12 as defined by the frame members 16, 18, 20 and 22 at grooves 46. Window 24 preferably comprises a relatively small thickness and is thus generally planar. Window 24 serves the purpose of protecting the contents of the frame from the negative effects of wear, dust, moisture, scratching and the like. However, elimination of the window 24 does not depart from the scope of the present invention. When window 24 is used, edges 58 (FIGS. 4 and 7) of window 24 are contained within grooves 46 as is at least one album cover 72. Preferably, the combined thickness of the window 24 and the one or more album covers 72 causes the combination to snugly fit within the grooves 46. This prevents the risk of breakage of window 24 due to unwanted displacement thereof within grooves 46. Window 24 is caused to be flush against the inside surface of the front flange 38. As desired, each groove 46 can be sized to accommodate storage of either a single or a plurality of album covers, with or without the audio recordings in each.

Figure 10:
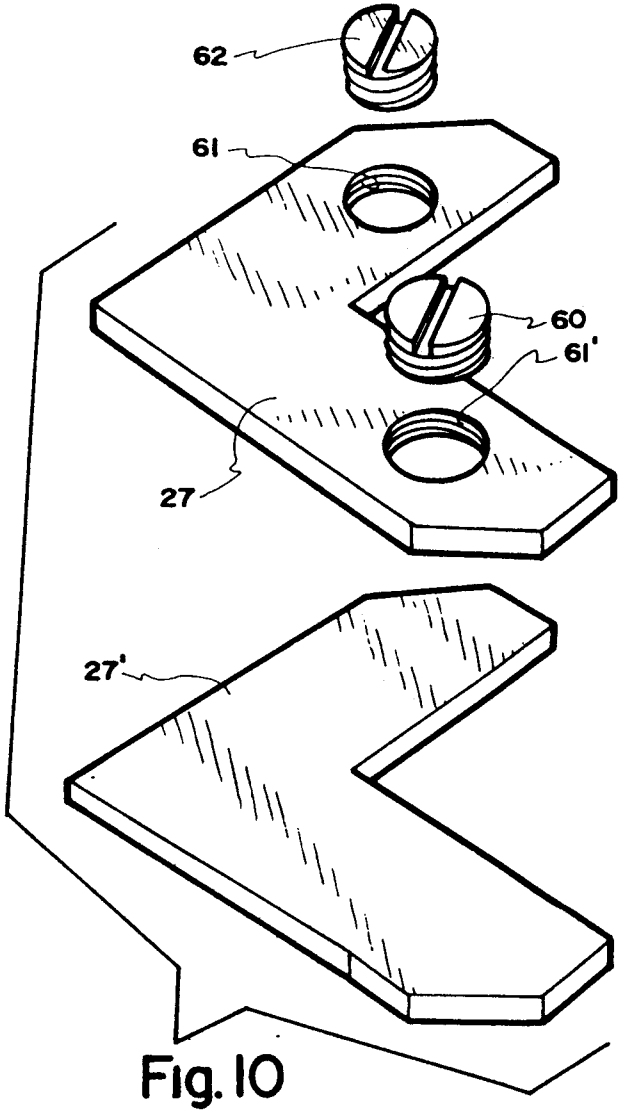
FIG. 10 is a perspective view of top and bottom angular rigid corner members.

Connectors 26 and 28 rigidly connect frame member 16 to frame member 18 at one corner, and frame member 18 to frame member 20 at a second corner. See FIGS. 2 and 10. Each connector 26 and 28 comprising two superimposed L-shaped plates 27 and 27', each of which is relatively flat. Each leg of plates 27 and 27' has a width slightly less than the width of frame members 16, 18 and 20 such that each leg of each plate extends well into but fits loosely within the associated aligned grooves 48 and 57.

Each leg of the exposed rearward most L-shaped plate 27 of each connector 26 and 28 comprises a pair of threaded apertures 61. The concealed or forward plate 27' of each pair of plates 27 and 27' is not apertured. A set screw 60 and 62 is threaded into each aperture 61 and tightened against the adjacent concealed plate 27', with the associated diagonal edges 41 of frame member 16, 18, 20 and 22 contiguous. This spreads each pair of superimposed plates 27 and 27', compressively forcing the exposed plate 27 against the inside surfaces of the flange 40 and the lip 56 while compressively driving the concealed plate 27' against the adjacent surface of flange 42. Consequently, the frame members 16, 18 and 20 are rigidly and contiguously joined to each other, as shown at the upper and lower right hand corners in FIG. 2.

The upper and lower left hand corners of the frame 12, as viewed in FIG. 2, comprise movable or displaceable connectors 30 and 32, which displaceably connect frame members 16 and 20, respectively, to frame member 22. The displaceable connector mechanisms 30 and 32 together with frame member 22 comprise an access frame gate, which is rectilinearly and rotationally manually displaceable from the position of FIGS. 2 and 5 through the position of FIGS. 3 and 6 to the position of FIGS. 4 and 7. This facilitates initial placement and subsequent insertion and removal of one or more desired album covers 72 into the interior of the frame 12. Each mechanism 30 and 32 is identical but of opposite hand and comprises two superimposed L-shaped plates 74. Each L-shaped plate 74 comprises a long leg 75 associated with frame member 22 and a short leg 82 associated with the rigid frame member 16, 20. The long leg of each exposed L-shaped plate 74 comprises a threaded aperture 61 in which a threaded set screw 62 is placed. Tightening of the two set screws 62 associated with the plates 74 compressively locks the long legs of the plates to the access gate frame member 22, as explained previously. Thus, the plate 74 is a first corner piece, attachment means or first corner portion, which is rigidly connected to one end of the access gate.

The short leg of each exposed plate 74 of each mechanism 30 and 32 is longer than the short leg of the concealed plate 70 and is connected to the left end (as viewed in FIG. 2) of the associated rigid frame member 16, 20 via a spring 76 connected at one hooked end 96 to pin 80 and via a corner slider bracket 78 slidably associated with the static frame. More specifically, short leg 82 of each exposed plate 74 is movably attached to frame member 16 or 20. Each short leg 82 comprises two side-by-side apertures 84 and 86 and a central aperture 85 offset somewhat from apertures 84 and 86. Apertures 84 and 86 receive two spaced bent over hooks or fingers 88 and 90 degrees integrally carried at the distal end of slider bracket 78 to thereby rotatably connect frame member 22 to frame member 16, 20. The respective ends of each cross pin 80 are anchored in apertures 81 disposed in flange 40 and base wall 36 well above the base wall 79. Anchor pin 80 thus spans the space 48 and comprises attachment means or a second portion of the movable corner structure rigidly connected to the static frame.

Each spring 76, as mentioned, comprises hooked ends 94 and 96. Hook 96 is placed over the associated anchor pin 80. Hook 94 is inserted through the associated aperture 85. There is sufficient distance between each associated aperture 85 and anchor pin 80 that the associated spring 76 is under tension at all times. Thus, the two springs 76 bias the frame member 22 toward the closed position of FIGS. 2 and 5 at all times in such a way that the spring 76 biases the access gate of the frame to attain and maintain a first closed position when the access gate is aligned with the static frame and to attain and maintain a second open position when the access gate is translated away from the static frame and rotated. Contrast FIGS. 2 and 4.

Each slider bracket 78 is essentially U-shaped in cross-section comprising central flat base wall 79 and opposed side flanges 83. Each side flange 83 is slotted at 89 to accommodate rectilinear to and fro travel of the slider brackets in respect to the associated pin 80. The slots 89 have distal and proximal surfaces 91 and 93 to accommodate the travel of the slider bracket 78. The base wall 79 merges into the two aforesaid spaced distal hooks 88 and 90, which respectively fit through the apertures 84 and 86 and pivotally clasp the associated short leg 82. Hooks 88 and 90 prevent separation of the attached plate 74 and bracket 78. This arrangement accommodates rotation of the frame member 22 and the four plates 74 in respect to the two brackets 78 and frame members 16 and 20 (to the position of FIGS. 4 and 7) after the frame member 22 is rectilinearly manually displaced from the position of FIG. 5 to that of FIG. 6 counter to the bias of the two springs 76. Engagement between stop surfaces 93 and pins 80 limits the amount of outward rectilinear displacement of frame member 22, i.e. between the positions of FIGS. 5 and 6.

Figure 1:
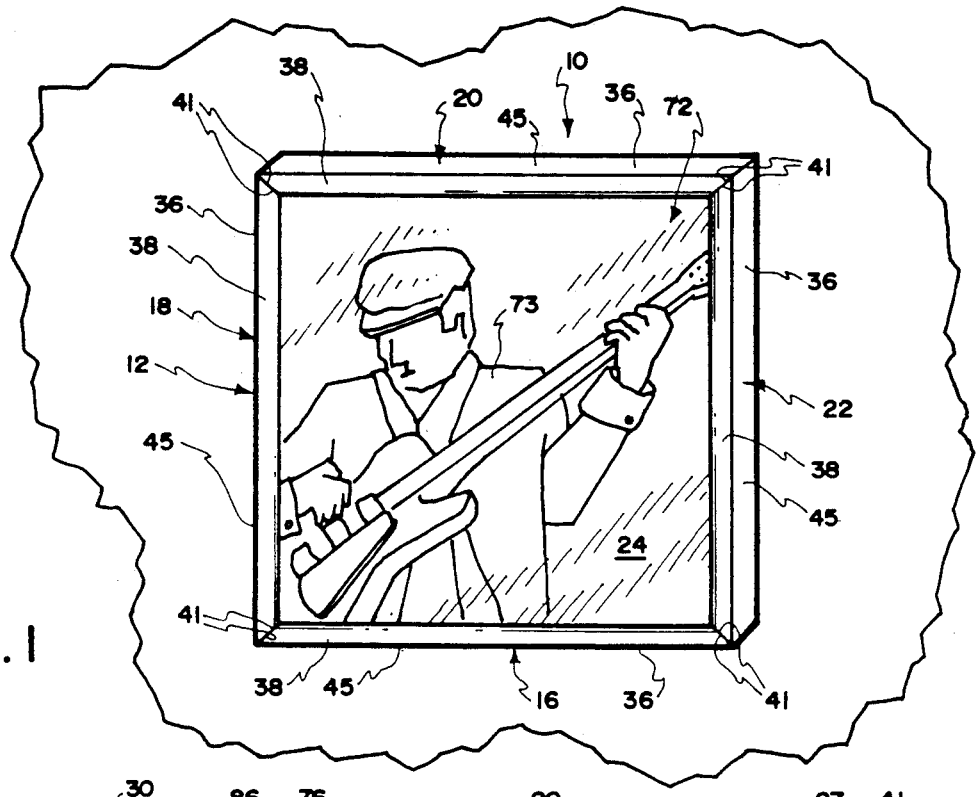
FIG. 1 is a front perspective view of a presently preferred audio recording storage and display frame, according to the present invention, shown suspended from a wall and containing a typical LP record jacket.

Hanging device 34 comprises a relatively flat piece of metal or other rigid material that has been rigidly connected to the top of the frame 12 at the midpoint of member 20. The device 34 has a corrugated bottom edge 98 which, when placed in contact with a nail, screw or similar fixture embedded in a wall, suspends the assembly 10 upon the wall, as shown in FIG. 1.

Figure 3:
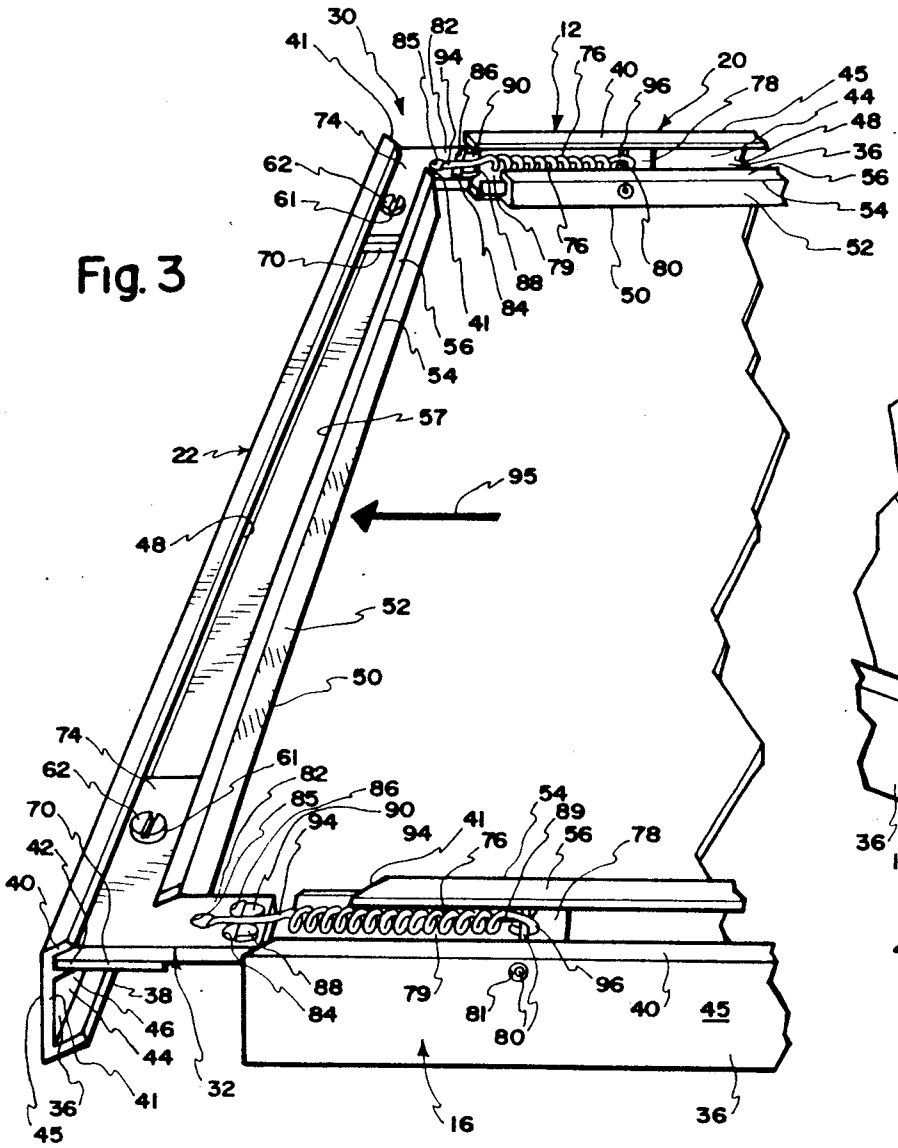
FIG. 3 is an enlarged fragmentary perspective view of the access frame gate of FIG. 2, shown manually extended outwards from the closed at rest position of FIG. 2 to a partially open position.
Figure 5:
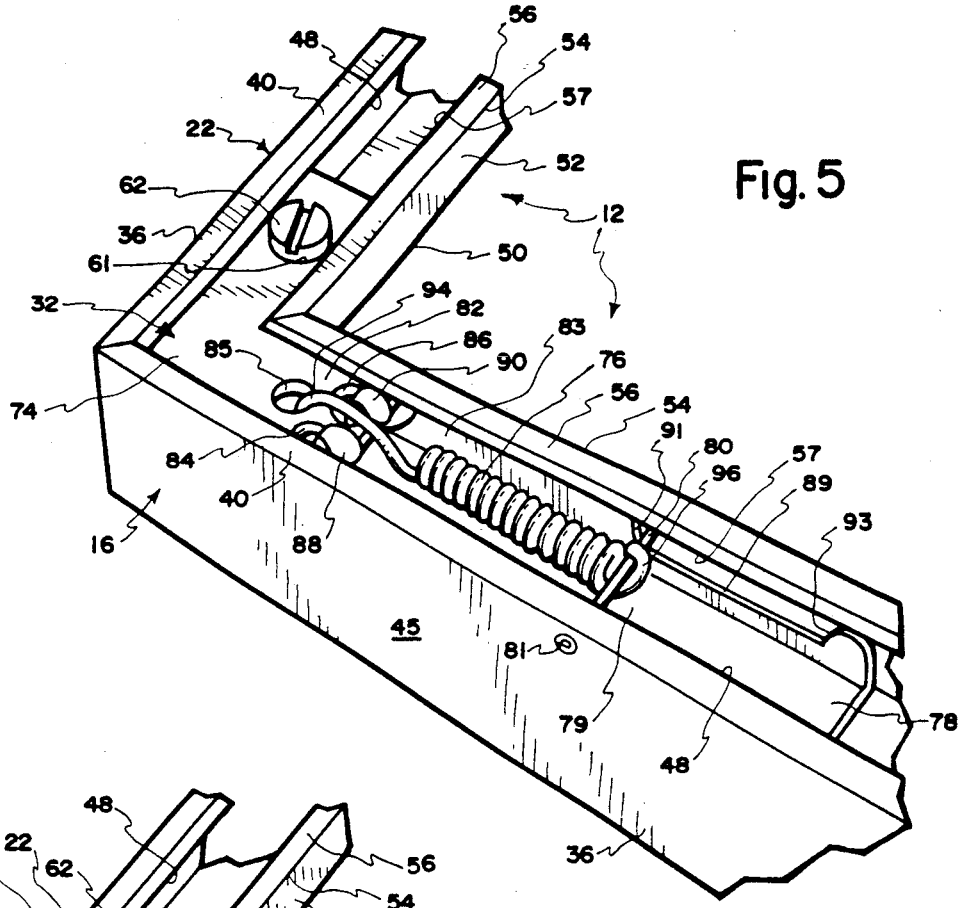
FIG. 5 is an enlarged fragmentary perspective view of the lower left corner of the access frame gate illustrated in FIG. 2, shown in it retracted at rest closed position.

To either remove or replace an LP record cover within the frame 12, the frame member 22 is firmly grasped in one hand by the user. While firmly holding the rest of the assembly 10 with the other hand, frame member 22 is rectilinearly displaced away from the rest of the frame as shown by arrow 95 (FIG. 3) until further movement in that direction is prohibited by engagement between stop surfaces 93 and pins 80. Thus, the position of FIGS. 3 and 6 is achieved.

Figure 4:
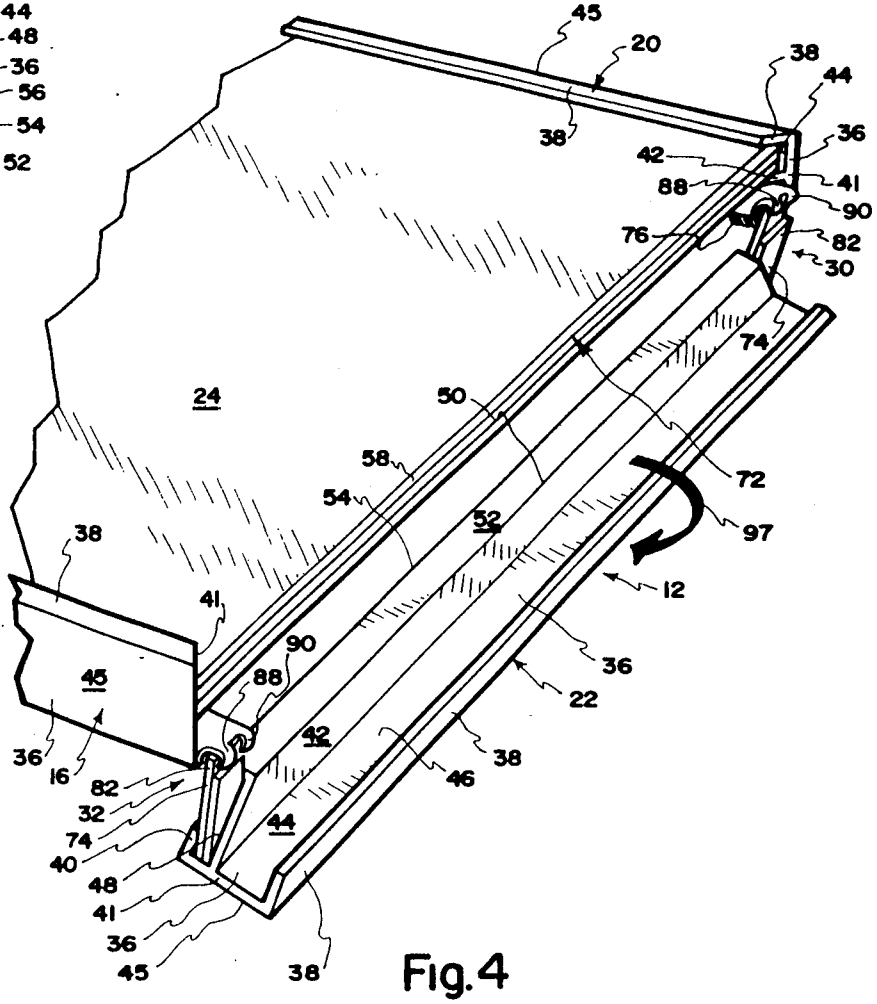
FIG. 4 is an enlarged fragmentary reverse angle perspective view of the access frame gate of FIG. 2, shown in the manually extended and fully rotated open position.

At this point, the user rotates frame member 22 about an axis comprising aligned apertures 84 and 86, as shown by arrow 97 (FIG. 4), which rotation is facilitated by the hooks 88 and 89 pivotally disposed in apertures 84 and 86. Accordingly, the inter-relationship of the apertures 84 and 86 and the hooks 88 and 90 comprise central rotatable means of the movable corner structure. Thus, the position of FIGS. 4 and 7 is achieved. In this position, bias of springs 76 in combination with rotation of frame member 22 locks frame member 22 into a stable open position and the user has free access to the interior of frame 12. In this position, frame member 22 is biased toward members 16 and 20 by springs 76, which holds frame member 22 in the extended and rotated position of FIGS. 4 and 7 without manual assistance. However, a slight amount of manual force will reverse rotate the access frame gate and cause return to the closed position of FIGS. 2 and 5.

Embodiments 13 and 14 are similar in principle to frame 12, but present only different access gate displacement mechanisms than embodied in frame 12. Since all parts excepting said displacement mechanisms are identical to frame 12, embodiments 13 and 14 are shown and described only in terms of the displacement mechanisms thereof. FIG. 8 illustrates a second presently preferred displacement mechanism or frame corner means 100, while FIG. 9 illustrates a third preferred displacement mechanism 102 or frame corner means.

Displacement mechanism 100 comprises two hinging sections 104 and 106. Each section 104 and 106 can be fabricated from metal or synthetic resinous material. Section 106 comprises a leaf spring 124. Two sections 104 are to be used, one to be connected to one end of one static frame member, e.g. frame member 16, and one end of a second static frame member, e.g. frame member 20. Since the two sections 104 are identical, only one will be described. Each section 104 comprises a cross-sectionally U-shaped bracket comprising a base wall 109 having a centrally-located threaded aperture 110 disposed therein, a square upright tab 112 located at the distal end of the bracket and integral with wall 109, and side walls 113 and 115 in which two transversely aligned apertures 114 and 116 are respectively and distally disposed. Section 104 is rigidly attached to the associated end frame member 16, 20 by a set screw 117 which is threaded into aperture 110 and tightened against the frame member to rigidly secure the frame member and the section together. It is to be appreciated that the association between frame member 16, 20 and section 104 is such that section 104 will project a predetermined distance for proper access frame gate operation, as explained hereinafter.

Since the two sections 106 and identical, only one will be described. One section 106 is mounted to each end of frame member, e.g. member 22, which functions as a manual access gate to expose the interior of the frame for manual ingress and egress of one or more album covers or the like. Each section 106 is L-shaped in its longitudinal configuration and U-shaped in its cross-sectional configuration. Each section 106 comprises an L-shaped base wall 119 disposed between two L-shaped side walls 121 and 123 which are integral with and normal to base wall 119. Walls 121 and 123 comprises aligned 90° corners 125 and 127, respectively, which are disposed along a common diagonal line, where the beveled or diagonal edges of the frame members contiguously contact each other when the access gate is closed.

A threaded aperture is located along the one leg of the base wall 119 most remote from section 104. A set screw 129 is threaded into each aperture 118 and tightened against the access gate frame member to rigidly secure the section 106 to the access gate frame member.

The leg of section 106 directly adjacent section 104 comprises aligned apertures 120 and 122 in side walls 121 and 123. The distal portions of walls 113 and 115 are sized to fit snugly inside adjacent walls 121 and 123 so that apertures 114, 116, 120, and 122 align, following which pivot pin 131 is force-fit through said aligned apertures to hinge sections 104 and 106 together.

Thus, frame member 22 is rotatably attached to frame members 16 and 20 by two connectors 100 each comprising hingedly connected sections 104 and 106.

The base wall 119 of the leg of section 106 adjacent the section 104 is partially severed to create upstanding leaf spring 124. When the aforesaid connection of the hinged sections 104 and 106 occurs to form connector 100, the free distal end 133 of the leaf spring 124 is caused to rest upon stop plate 112. Thus, when the fully assembled access gate frame member, with section 106 attached at each end, is manually pivoted through 90 or more degrees, the access gate frame member will be biased in a fully pivoted, open position. The gate frame member is retained in this position without manual assistance. However, a slight rotation of the access gate frame member from the fully rotated open to a position less than 90 from the closed position will cause the leaf spring to bias the access gate frame member into the fully closed position.

Reference is now made to FIG. 9 which illustrates a displaceable connector 102. The frame members per se have already been described and, therefore, are not shown for ease of illustration and brevity of description. It is understood that both corners of the access gate frame member of embodiment 14 will each be equipped with a connector 102. Since the two are identical, only one connector 102 needs to be described.

The movable connector 102 comprises a substantially linear section 126, an L-shaped section 128 and a coiled tension spring 136. Preferably the sections 126 and 128 are formed from a suitable synthetic resinous material using conventional injection molding techniques.

The section 126 comprises a base wall 141, which is illustrated as being of uniform thickness throughout. The base wall comprises enlarged proximal and distal end portions 143 and 145, respectively, separated by a narrow region 149. Section 143 is interrupted by a threaded aperture 130. Adjacent aperture 130 are upstanding fore and aft flanges 142 and 147. Flange 147 traverses the entire transverse dimension of section 143, whereas flange 142 traverses only the difference between the width of section 143 and the necked down section 149. Flange 142 comprises aperture 153. A side flange 151 integrally connects to the base wall 141 and extends longitudinally a distance equal to the axial distance of base wall sections 145 and 149. Enlarged base wall section 145 is uninterrupted, but comprises fore and aft upstanding flanges 146 and 148, each of which comprises an aperture. Flange 146 comprises aperture 132, which is circular in its configuration having a diameter sized to accommodate passage of spring 136 therethrough. Flange 148 comprises key hole-shaped aperture 132. The key-shaped aperture 132 is substantially circular interrupted by a substantially rectangular notch 150.

The proximal hooked end 155 of spring 136 is connected or attached to section 126 at aperture 153 in flange 142. The distal hooked end 157 is secured to the section 128 to spring bias section 128 into a closed position, as hereinafter more fully explained.

A set screw 159 is threaded into aperture 130 when the section 126 is properly disposed in relation to static frame member 16, 20 and is tightened to immovably secure section 126 to its associated frame member 16, 20.

The L-shaped section 128 comprises a short leg 161, which is recessed at 163. The recessed area 163 centrally comprises a threaded aperture 165 into which a set screw 167 is threaded and tightened against the access gate frame member 22 to secure section 128 to the access gate frame member. The L-shaped section 128 comprises outside and inside corners 169 and 171. A plane containing corners 169 and 171 defines the contiguous interface between the static frame member 16, 20 to which section 126 is attached and the access gate frame member to which section 128 is attached when in the closed position. The long leg 173 of the section 128 is aligned with section 126 and comprises an abutment or shoulder 175 from which a relatively thin, flat bar 154 extends.

Bar 154 is stepped at shoulder 177. Shoulder 177 comprises a stop surface adapted to engage upstanding flange 148 adjacent slot 150 to limit the amount of spring-biased retraction to which member 126 is subjected, as hereinafter explained. The width of the distal portion 179 of the bar 154 is substantially equal to the maximum transverse dimension of the key-hole shaped aperture 134 at slot 150. Thus, the distal portion 179 of the bar 154 may reciprocate rectilinearly back and forth in aperture 134. The hooked end 157 of the spring 136 is fitted through a distal aperture 160 in bar section 179. Also, once the distal end section 179 of the bar 154 is inserted through the key-hole aperture 134, a cotter key 158 is inserted also through the aperture 160 to prevent total withdrawal of the distal end section 179 from the aperture 134. This prevents the imposition of excessive tension upon spring 136.

Thus, in the assembled condition, the end section 179 of the bar 154 extends through the aperture 134 and at a predetermined distance above the section 141, with the spring 136 biasing section 128 into a closed position. The stop surface 177 engages the front surface of the upstanding flange 148 in the closed position. In this condition, the associated frame is closed with the frame members thereof contiguous one with another at the diagonal corners.

When access to the interior of the frame is desired, the access gate frame member, with the two sections 128 attached thereto at the opposite ends thereof, is manually rectilinearly translated in a direction axially away from sections 126. When fully extended against the bias of the two springs 136, the access gate frame member 22 and sections 128 may be laterally displaced slightly to provide clearance for insertion and removal of an album cover or the like into or from the open frame. Upon manual release of the access gate frame member, the bias of the springs 136 cause the sections 128, together with the attached access gate frame member 22 to be retracted into the closed position.

Figure 11:
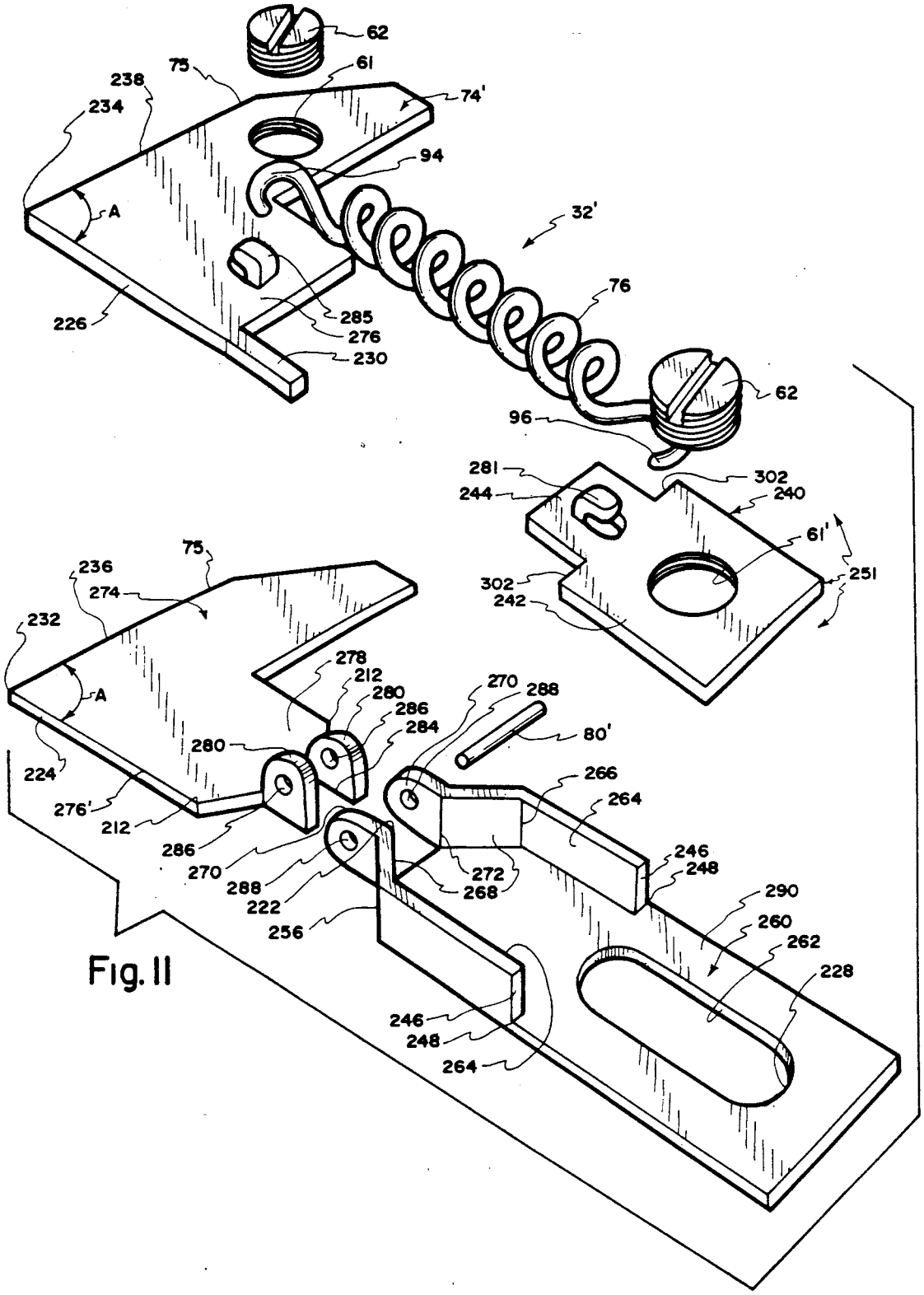
FIG. 11 is an exploded perspective view of a fourth presently preferred movable connector used in conjunction with an access frame gate structure of a frame suitable for display of a compact disc package.

A fourth preferred embodiment is shown in FIGS. 11–14. Similar in principle to the prior three embodiments this fourth embodiment comprises a different gate displacement mechanism than the embodiments previously described. As is true in respect to embodiments 13 and 14, all parts of the fourth preferred embodiment, except for a displacement apparatus unique in this embodiment, are identical to frame 12. Therefore, in respect to the preferred embodiment of FIGS. 11–14, only the displacement apparatus needs to be described. FIG. 11 shows an exploded view of a displaceable corner connector mechanism or frame corner means, generally designated 251, comprising two set screws 62, two L-shaped plates 74' and 274, lock plate 240, hinge pin 80', spring 76, and slotted corner slider bracket 260 slidably associated with the static frame.

Lock plate 240 comprises rectangular lock plate body 242 and lock plate tongue 244, which is integral with the lock plate body 242. The combined lengths of tongue 244 and body 242 comprise the length of lock plate 240. Lock plate body 242 is wider than lock plate tongue 244 and comprises shoulder extensions 302, which extend outward from the location where lock plate body 242 and lock plate tongue 244 connect. Centrally disposed in lock plate body is a threaded aperture 61'. Lock plate body 242 has a width slightly less than the interior width of the rearwardly exposed groove 48 in the frame members 16 and 20 such that each lock plate 240 slidably fits into aligned groove 48. Lock plate tongue 244 comprises spring catch finger 281, medially positioned as shown in FIG. 11, to which one end of spring 76 is affixed as later described. Lock plate 240 is preferably steel and Finger 281 is preferably formed using conventional die stamping techniques. Thus, the lock plate 240 comprises attachment means or a third portion of the movable corner structure rigidly attached to the static frame.

Slotted slider bracket 260 comprises a flat slider plate section 290 and integral side flange members 264. Slider plate section 290 further defines an elongated bracket slot 262 and provides integral base support for side flange members 264. Bracket slot 262 is medially positioned and extends longitudinally in flat slider plate section 290 and comprises a length at least as long as the travel requirement of the access gate. Bracket slot 262 is sufficiently wide that set screw 62, when threaded into threaded bore 61 will pass in spaced relation through the slot 262 and will not cause binding as slotted slider bracket 262 is reciprocated longitudinally back and forth in groove 48.

Proximal attachment of side flange members 264 to slider plate 290 begins at sites 248. The position of each site 248 is determined by placing the distalmost edge of screw aperture 61' in juxtaposed placement over the distalmost part of distal slot edge 304 of bracket slot 262 such that shoulder extensions 302 are distally positioned relative to screw aperture 61'. Position of each site 248 is selected such that shoulder extensions 302 do not contact either edge 246. From sites 248 slider plate and side members extend distally to form a tongue or clevis. Specifically, the flange member 264 are proximally parallel, but respectively merge at bend lines 256 and 266 into convergent flange sections 268, the distal ends of which merge at bend lines 272 and 222 with two parallel tongue members 270 by which bracket 260 is pivotally joined by pin 80 to plate 274. Apertures 288 formed in juxtaposed relation to hinge tongue members 270 tightly receive pin 80'.

Two L-shaped plates 74' and 274 comprise attachment structure for the access gate. It should be appreciated that L-shaped plates 74' and 274 comprise attachment structure for the left corner (as viewed in FIGS. 11–14) of the access gate frame member whereas a mirror image of plates 74' and 274 is used to form the attachment structure for the right corner of the access gate. Indeed, the members 74' and 274 comprise attachment means or a first corner portion rigidly connected to one end of the access gate. Top L-shaped plate 74' comprises a long leg 75, which comprises a centrally disposed set screw-receiving threaded aperture 61, and a short leg 276, which defines a distal spring-receiving die stamped finger 285 and a cantilevered guide arm 230. Long side 226 of short leg 276 extends from distal side 238 at corner 234 subtending acute angle A. Acute angle A preferably comprises an angle of 85° to 87° which provides sufficient taper to assure freedom from binding when the access gate is opened and closed.

Bottom plate 274 comprises an apertureless long leg 75 and a short leg 276', which comprises plate base 278 and two upright hinge members 280. Dimension of long legs 75 are substantially the same as described for the first preferred embodiment. Short leg 276' comprises long side edge 224 which extends from distal side edge 236 subtending acute angle A. As is the case of top L-shaped plate 76', acute angle A of bottom L-shaped plate 274 comprises an acute angle of 85° to 87° which provides sufficient taper to assure freedom from binding when the access gate is opened and closed.

On the proximal end of the short leg 276', base plate 278 is tapered inwardly then merged into an upstanding clevis in the form of two ears 280. Upright hinge members or ears 280 are spaced to fit between tongue hinge members 270. A pivot pin aperture 286 is disposed in each ear 280 and is of the same diameter as apertures 288. When all four apertures 286 and 288 are aligned and pin 80' snugly inserted therethrough, a common hinge is created. Thus, the pin 80' and the associated apertures 286 and 288 comprise central rotatable means of the movable corner structure.

Preparatory to attaching access gate frame member 22 to frame members 16 and 20, both L-shaped plates 74' and 274 are secured to frame 22 in the same manner described earlier. Also lock plates 240 are immovably affixed to frames 16, 20 with spring catch finger 281 correctly oriented and exposed so as to be disposed distally of screw aperture 61'. In assembly, each set screw 62 is threaded through screw aperture 61' so as to pass through bracket slot 262 in spaced relation and tightened against the frame 16, 20 to compressively and rigidly affix lock plate 240 to each frame 16, 20. Screw 62 in bracket slot 262 acts as a stop against proximal edge 228 of slot 262 thereby limiting travel of slider bracket and thereby limiting outward travel of frame member 22 to a desired, predetermined amount.

Upright hinge members 280 are interposed between tongue hinge members 270 and hinge pin 80' is inserted through four apertures 286 and 288 to complete the hingeable attachment. Hook ends 96 and 94 of spring 76 are hooked around fingers 281 and 285, respectively. Finally, the position of lock plate 240 may be adjusted as necessary or desireable by loosening set screw 62, moving lock plate 240 such that spring 76 is subjected to a desired amount of tension, and retightening set screw 62.

Figure 12:
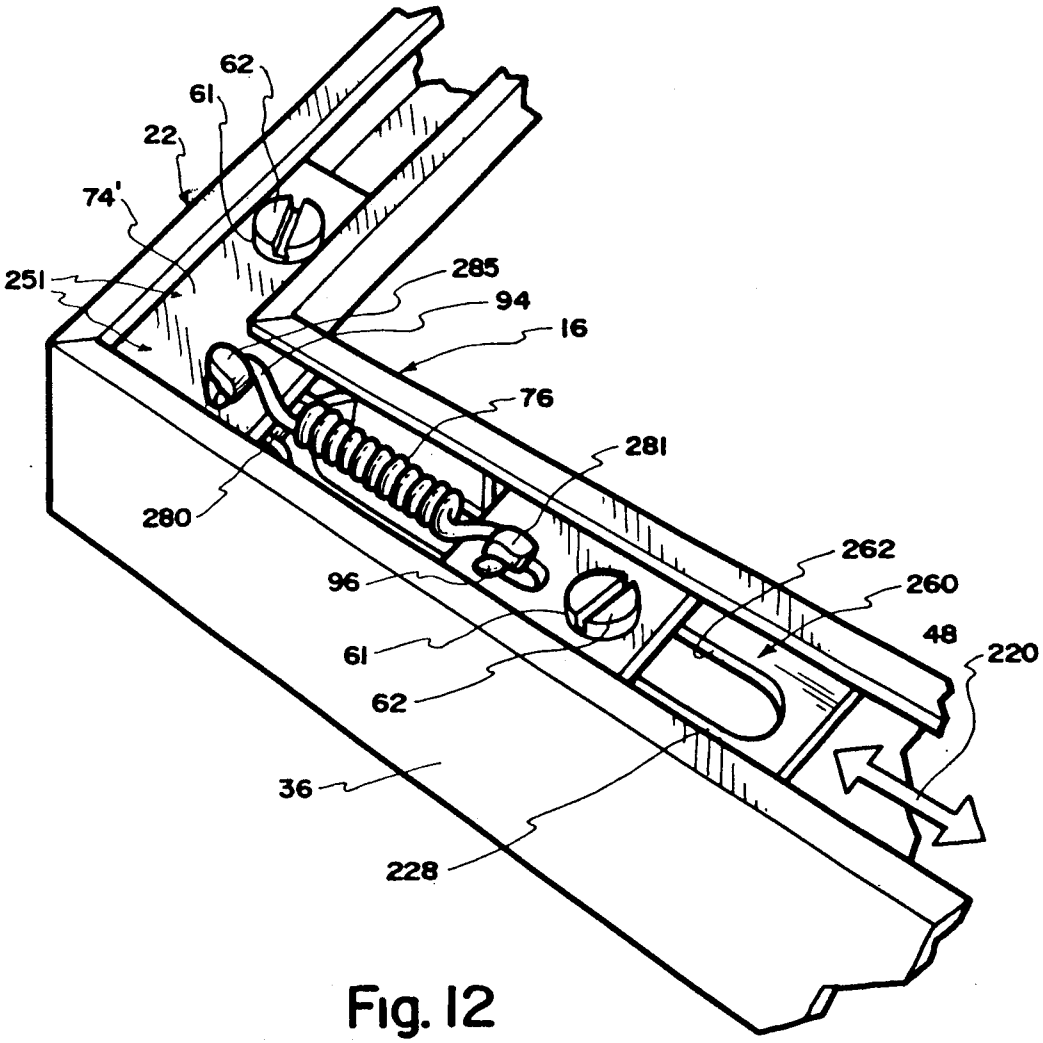
FIG. 12 is an enlarged fragmentary perspective view of the fourth presently preferred embodiment of the access frame gate in its closed position.
Figure 14:
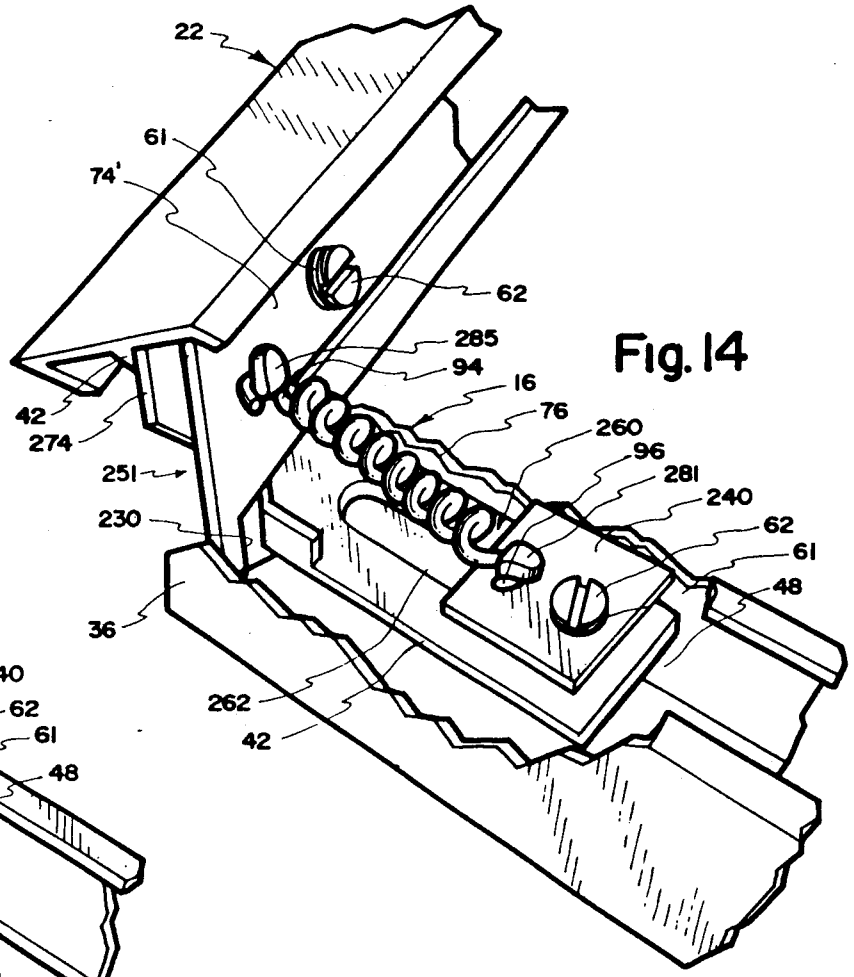
FIG. 14 is an enlarged fragmentary view similar to FIG. 13, but showing the access frame gate rotated from the extended position to the stable open position.
Figure 13:
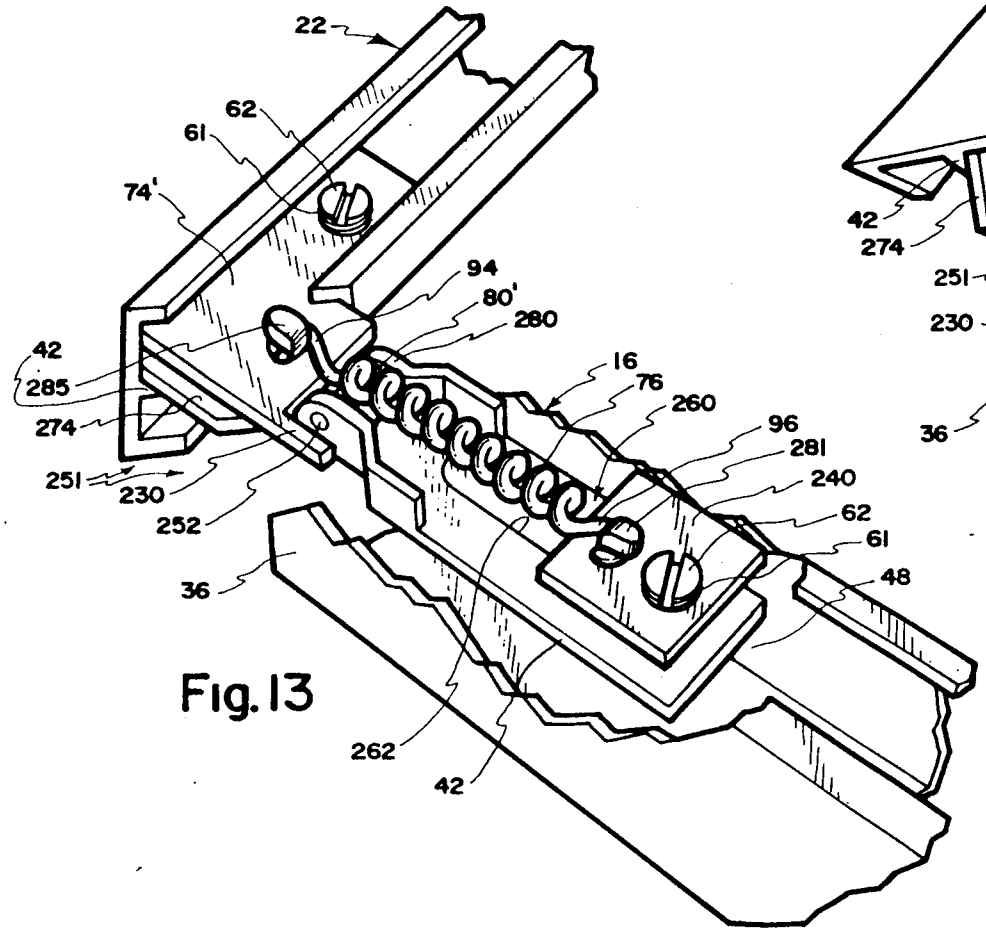
FIG. 13 is an enlarged fragmentary view similar to FIG. 12, but with a portion of edge member 16 cut away and showing the access frame gate manually extended outward from the closed position.

The completed assembly of corner connector mechanism 251 with frame gate 22 in closed position is shown in FIG. 12. The closed and open, rotated positions of frame gate 22 comprise two stable states. When the position is a first closed position, frame member 22 is firmly biased by spring 76 against the associated disposed edge member 16 or access gate 20. To move frame gate to the stable open position, access gate frame member 22 is grasped in one hand and the rest of frame assembly 10 is held in the other. Frame member 22 is first rectilinearly displaced away from the rest of the frame to the position shown in FIG. 13. Outward travel is limited by engagement between the proximal edge 228 of slot 262 and the set screw 62 which extends through slot 262. When the outward rectilinear travel limit is reached, frame member 22 is manually rotated about an axis comprising hinge pin 81' and released. The bias of spring 76 pulls frame member 22 in a short distance toward frame member 16, 20 causing cantilever arm 230 to contiguously engage the adjacent bevelled corner edge of frame member 16, 20. This second, open position is shown in FIG. 14. Spring 76 thus applies tensile force which pulls rotated frame member 22 toward frame member 16, 20 which statically holds member 22 in the position of FIG. 14 thereby establishing a stable open state. To reestablish the stable closed position, frame member 22 is pulled away from frame member 16, 20 and counter-rotated to align guide arm 230 with the plane of travel of slide bracket 260. Frame member 22 is then released and spring 76 retracts member 22 to the position of FIG. 12.

Reference is now made to FIGS. 15 through 20, which collectively illustrate a further presently preferred corner connecting mechanism, generally designated 350, fashioned according to the principals of the present invention. Connector mechanism or frame corner means 350 comprises an exposed L-shaped plate number 352, a set screw 60, a concealed L-shaped plate 354 over which plate 352 is superimposed in the assembled condition illustrated in FIG. 15, spring 76', pivot pin 356 and corner slider bracket 355, which is linearly slidably associated with the static frame member.

Frame member 16' differs from previously described frame member 16 in that a spring receiving finger 360 is illustrated as having been formed from the material comprising the base of groove 48, for example, by die stamping. The location of finger 360 is selected to cause spring 76' to apply the appropriate magnitude of tension to the access gate frame member 22 so that it is biased against inadvertent displacement when cause to attain and maintain its first closed position, illustrated in FIG. 15, or its second extended rotated position, illustrated in FIG. 20. Thus, finger 360 comprises attachment means or a portion by which the movable corner structure is rigidly connected to the static frame.

The frame member 16 also defines at the base of groove 48 a stop protrusion 362 which is preferably also die stamped. Protrusion 362 is sized so as to function as a stop, as hereinafter more fully explained, and is located so that the amount of travel available to slide bracket 355 is of a predetermined magnitude accommodating displacement of the corner mechanism 350, first to the position of FIG. 16 and thereafter to the position of FIG. 20.

Plate 354 comprises a long leg placed in contiguous relationship with the floor of the groove 48 and is substantially identical to leg 75 of plate 274 of FIG. 11. L-shaped plate 354 comprises a short leg 364 which is entirely planar with the exception of the distal edge 366 which is arcuately bent toward plate 352, when assembled, so as to be out of the way in accommodation of the hinging action hereinafter explained in greater detail.

The plate 352 comprises a long leg placed in groove 48 of access gate frame member 22. This leg is identified by the numeral 75 since it is identical to leg 75 of plate 74' shown in FIG. 11.

Figure 15:
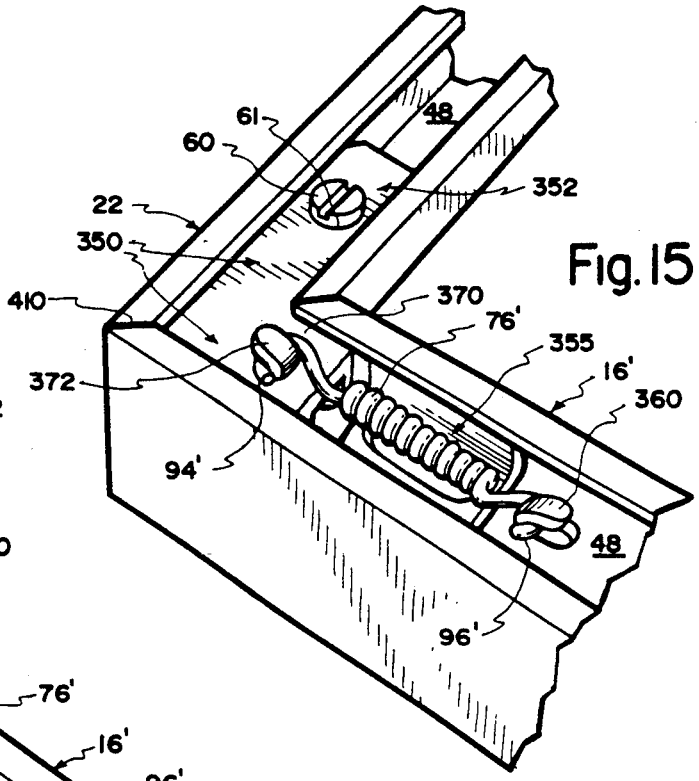
FIG. 15 is a fragmentary perspective of still another presently preferred corner connector structure for an access frame gate (shown closed) of a frame suitable for display of a compact disc package.
Figure 16:
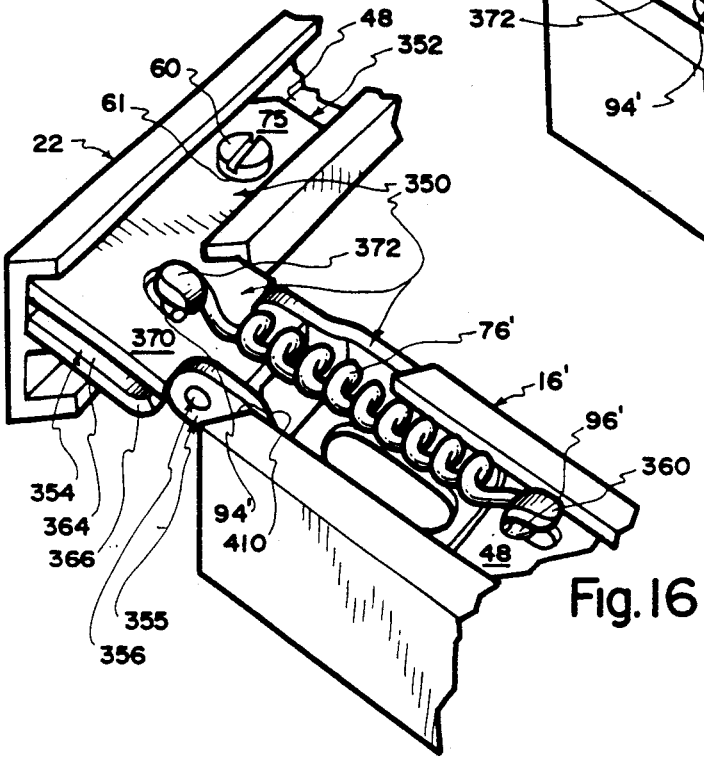
FIG. 16 is a fragmentary perspective of the corner connector structure of FIG. 15, shown in a linearly open position.
Figure 17:
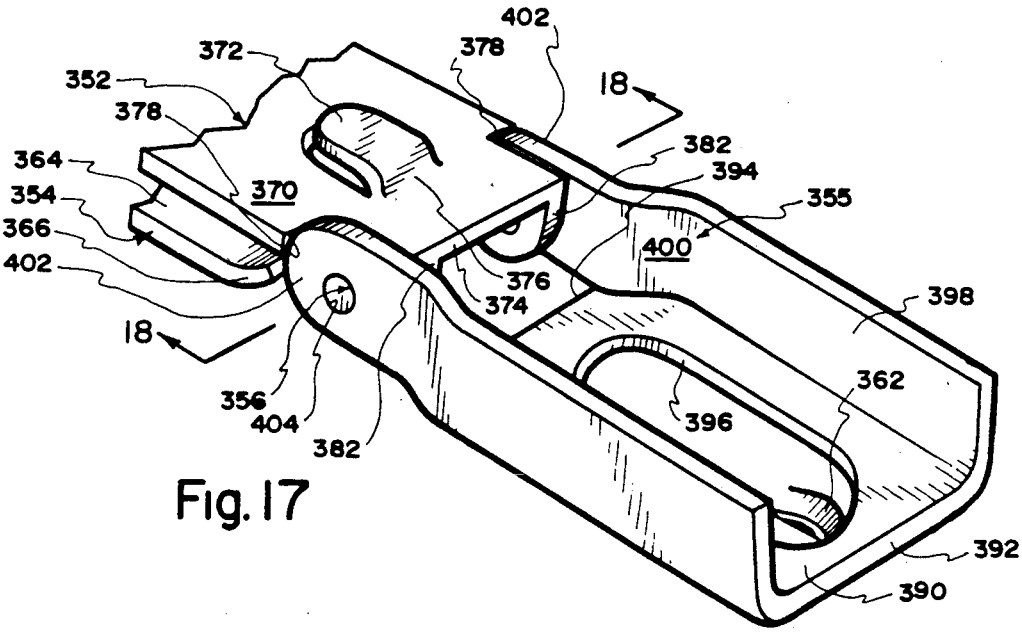
FIG. 17 is a fragmentary perspective of two hinged members of the corner connector of FIG. 15.
Figure 18:
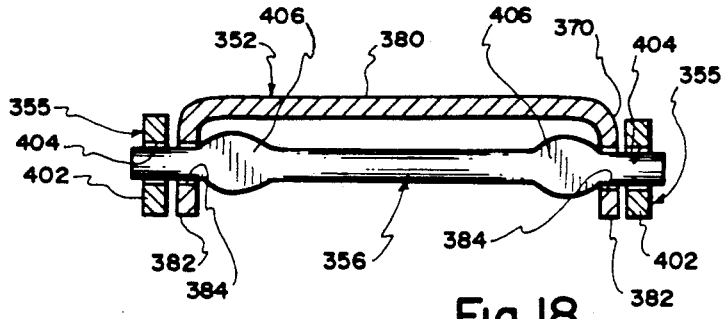
FIG. 18 is a cross section taken along lines 18—18 of FIG. 17.

Plate 352 also comprises a short leg 370 extends into the groove 48 of frame member 16' when assembled and positioned in the closed position illustrated in FIG. 15. Short leg 370 is substantially planar except a spring end receiving finger 372 is illustrated as having been diestamped from the leg 370 in a central location a predetermined distance from the distal edge 374 of the leg 370 in a direction toward frame member 22. The spring end receiving finger 372 extends also in a direction towards frame member 22. At locations generally transverse to the connection site 376 of the finger 372 are opposed shoulders 378. A necked down hinge forming tongue 380 constitutes the distal segment of the short leg 370. Tongue section 380 is integral with the remainder of the leg 370, but is reduced comprising the width of shoulders 370. The tongue section 380 is centrally planar and terminates in opposed ears or lugs 382, each of which contains an aperture 384. The apertures 384 are aligned one with the other and are of the same diameter. The apertures 384 receive the previously mentioned pivot pin 356, as hereinafter more fully explained. As explained earlier, spring 76' is a tension spring, the memory of which tends to retract the spring at all times into its maximum collapsed position. Spring 76' comprises looped ends 94' and 96', which are respectively placed over oppositely extending fingers 372 and 360.

Figure 19:
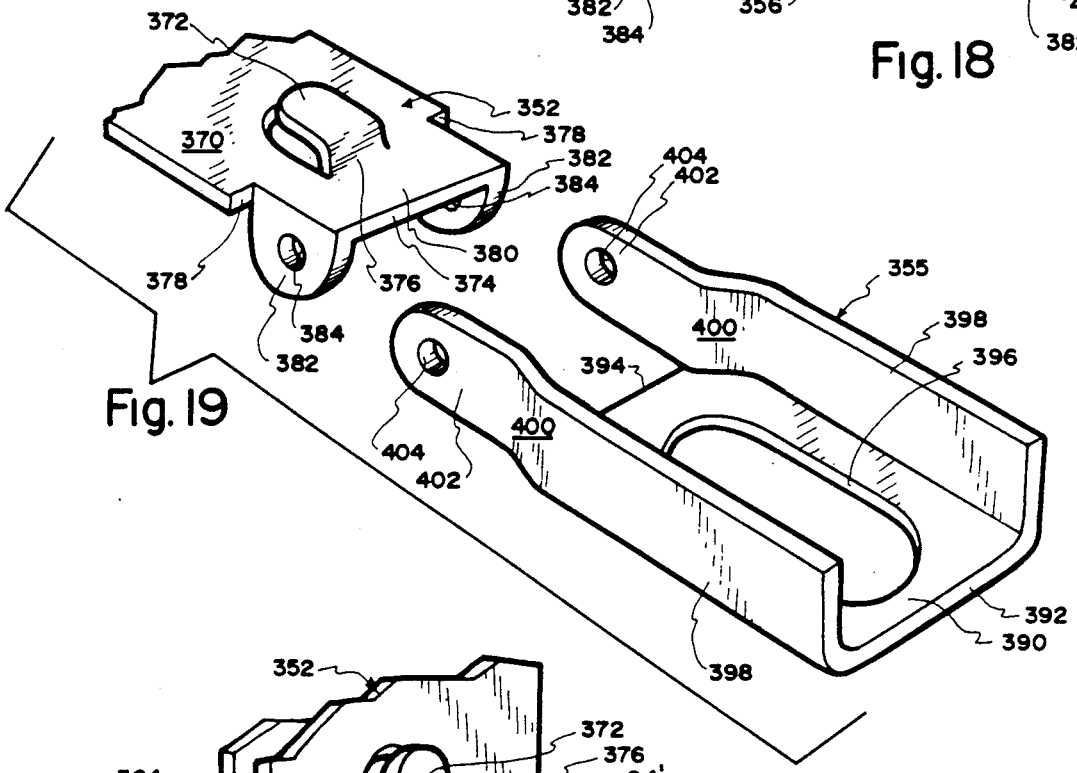
FIG. 19 is an exploded fragmentary perspective of the two hinged members of FIG. 17.

Slider bracket 355, as is best illustrated in FIG. 19, is integral or of one piece construction, and comprises a flap or planar base 390 which terminates in a rear transverse edge 392 and a forward transverse edge 394. A longitudinally elongated slot 396 is centrally disposed in the base 390. The slot 396 in conjunction with the heretofore mentioned frame stop 362 determines the extent to which the slider bracket 355 can be displaced in a forward direction along slot 48 of frame member 16 prime.

Base 390 merges into opposed side flanges 398 which are illustrated as being of uniform height and thickness throughout their respective lengths. Flanges 398 are spaced one from the other a distance sufficient to place the flanges 398 beneath the opposed lips at the top of groove 48 of frame member 16' so that inadvertent removal is not possible, but said distance, out-to-out between the flanges 398 is less than the width of the groove 48 to accommodate the aforementioned linear reciprocation. The flanges 398 are substantially coextensive with the base 390. However, adjacent the leading edge 394, the flanges 398 merge with converging sections 400 which constitute an extension of the flanges 398, respectively. In turn, the transition sections 400 integrally merge with spaced lugs 402. Lugs 402 are parallel to flanges 398, but are more closely spaced. The out-to-out distance across the lugs 402 is substantially equal to the width of the leg 370 at a location proximal of the tongue 380. The transverse dimension between the interior surfaces of lugs 402 is substantially the same as the out-to-out spacing between ears 382 so that tongue section 380 fits snugly, although rotatably between the lugs 402 as shown best in FIGS. 17 and 18. Each lug 402 comprises an aperture 404. Apertures 404 have the same diameter which is the same diameter as apertures 384. Apertures 384 and 404 are located in such a way that when tongue 380 is inserted between lugs 402, the apertures 384 and 404 are aligned, one with another, at which time pivot pin 356 is inserted through all four apertures. Thereafter, pivot pin 356 is crimped at sites 406 (FIG. 18) to enlarge the transverse size of the pin at the crimped sites, thereby preventing inadvertent removal of the pivot pin 356 from its assembled condition. When the corner connector mechanism 350 is assembled and installed at the mitered corner between frame members 22 and 16', set screw 60 is threaded snugly in threaded bore 61 and tightened so as to force against under plate 354, thereby compressively urging plate 354 against the bottom of the groove 48 of frame member 22 against inadvertent displacement. Thus, the plates 350 and 354 comprise attachment means or a first corner portion rigidly connected to one end of the access gate. The hinge formed at pivot pin 356 is assembled as explained earlier with the slider bracket 355 slidably disposed in the groove 48 of the member 16' so that stop protrusion 362 projects upwardly in slot 396. The pivot pin 356, in its assembled position, comprises central rotatable means for the movable corner structure. The ends 94' and 96', respectively, of spring 76' are looped over opposed fingers 372 and 360, respectively. The force of the spring 76' is such that short leg 370 of L-shaped plate 352 is linearly received into the distal portion of groove 48 of frame member 16'. This places the frame members 22 and 16' as well as the corner connector mechanism 350 in the position of FIG. 15, the spring 76' exerting a retracting force so that the frame members 22 and 16' are either contiguous or nearly so at the mitered interface in between.

A second corner connector mechanism 350, of opposite hand, is similarly interposed between frame member 22 and a second frame member disposed parallel to frame member 16' to complete the double hinged connection of access gate frame member 22 to the remainder of the frame, as was heretofore explained in greater detail.

Figure 20:
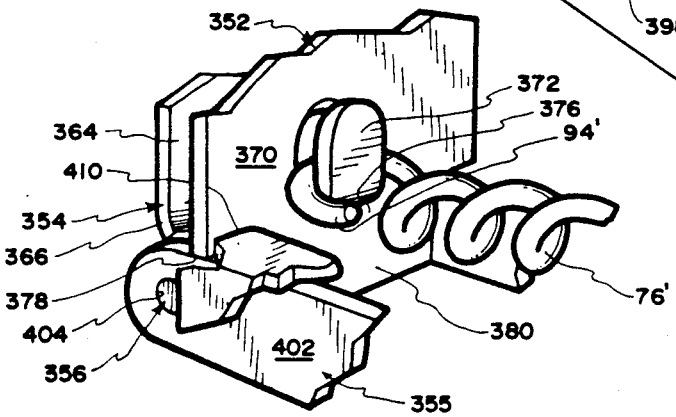
FIG. 20 is a fragmentary perspective of the corner structure of FIG. 15, shown in its rotated stationary open position.

When the user desires to access to the interior of the frame comprising frame members 22 and 16' for purposes of placing or removing the packaging in which a sound recording is placed, the user manually grasps in one hand frame member 22 and the remainder of the frame in the other hand. Frame member 22 is manually pulled from the position of FIG. 15 to that of FIG. 16 so that the orientation of frame member 22 remains substantially normal to the access of frame member 16'. When in the position of FIG. 16, the hinge structure comprising pivot pin 356 is clear of the distal or leading edge of the frame member 16' so that relative rotation between frame members 22 and 16' may be readily achieved. Accordingly, the user rotates frame member 22 about an axis comprising pivot pin 356 through approximately ninety degrees. This occurs when shoulders 378 engage the top edges of lugs 402, as best illustrated in FIG. 20. Next, the user decreases the magnitude of manual force until the manual force is less than the force of the two spring 76'. This causes frame member 22 to be pulled toward frame member 16' a short distance until the short leg 370 of plate 352 adjacent one shoulder 378 makes contact with the mitered distal edge of frame member 16' at site 410. See FIG. 20.

At this point, the user releases all manual force from the extended and rotated frame member 22 whereupon the two spring members 76' statically and stably hold frame member 22 in the rotated open position shown in FIG. 20. The user next removes and/or inserts the packaging in which a sound recording is sold, with or without the sound recording contained therein.

The invention may be embodied in other specific forms without department from the spirit or essential characteristics thereof. The present embodiments are, therefore, to be considered in all respects as illustrative and not restrictive, the scope of the invention being indicated by the appended claims rather than by the foregoing description, and all changes which come within the meaning and range of equivalence of the claims are therefore to be embraced therein.

What is claimed and desired to be secured by United States Letters Patent is:

1. Artistic display structure comprising:

audio recording container means comprising a planar face, comprising exposed artwork, compartment means adapted to receive an audio recording, and a perimeter bounding the face;

display frame means sized and shaped to generally surround the perimeter of the audio recording container means when placed therein, the frame means comprising frame corner means which further comprise two translatable and rotatable connector means and movable access gate means comprising opposite ends, the corner frame means comprising means allowing for the movable access gate means to both translate and rotate with respect to static frame means, the access gate means being movably connected to the static frame means at the opposite ends thereof by the translatable and rotatable connector means by which the access gate means are manually opened by first translation and then rotation to one stable self-retaining position and closed by first rotation and then translation to another stable self-retaining position for selective ingress and egress of the container means;

the display frame means further comprising means defining a visually open front for exposing to view the artwork when the container means are disposed within the display frame means.

2. The artistic display structure according to claim 1 comprising transparent window means spanning the visually open front over the artwork.

3. The artistic display structure according to claim 1 wherein the container means comprise at least one album cover of a long playing record or compact disk.

4. The artistic display structure according to claim 1 comprising means carried by the display frame means by which the display frame means are suspended from a wall or other vertically disposed display area.

5. The artistic display structure according to claim 1 wherein the static frame means comprise three side frame members rectangularly connected to define three perimeter sides of the display frame means, the movable access gate means comprising the fourth side thereby completing a rectangular perimeter of the display frame means.

6. The artistic display structure according to claim 1 wherein each translatable and rotatable connector means comprise memory biasing means which urge the ends of the access gate means to a closed stable position but accommodate manual translation and rotation of the access gate means away from the static frame means to the open stable position.

7. The artistic display structure according to claim 1 wherein each translatable and rotatable connector means comprise translation guide means which slidably engage the static frame means accommodating manual translation of the access gate means away from the static frame means.

8. The artistic display structure according to claim 1 wherein each translatable and rotatable connector means comprise corner hinge means by which the access gate means are manually rotated out of alignment with the static frame means to an open stable position after translation.

9. The artistic display structure according to claim 1 wherein each translatable and rotatable connector means comprise slidable guide and rotatable pivot means accommodating successive manual translation and rotation of the access gate means away from and in respect to the static frame means to an open stable self-retaining position.

10. The artistic display structure according to claim 9 wherein the slidable guide and rotatble pivot means comprise corner bias means and corner hinge means.

11. A method of displaying artwork on a container adapted to receive an audio recording comprising the steps of:

providing an artistic display frame comprising means for defining a visually open front for exposing container art work to view, a stationary portion of the frame and a frame access gate which comprises means for translatably and rotatably connecting the frame access gate to the stationary frame, the connecting means further comprising means for restraining the frame access gate translated and rotated away from the stationary portion of the frame when so disposed and in aligned spaced relation with the stationary portion of the frame when so disposed;

manually rectilinearly translating the frame access gate of the display frame away from the stationary portion of the frame into a spaced but aligned position and thereafter hinge rotating the access gate out of alignment with the stationary portion of the frame, the restraining means causing the access gate to remain in the out of alignment position without application of manual force;

manually rectilinearly translating the container in close proximity to and past the access gate into the interior of the display frame so that the artwork is visually exposed at the visually open front of the display frame;

manually rotating the frame access gate into aligned spaced relation with the stationary portion of the frame and thereafter accommodating rectilinear translation of the access gate into its initial position.

12. The method according to claim 11 wherein the manually rectilinearly translating step comprises translating the translatable and rotatable connecting means together with the frame access gate in respect to the stationary portion of the frame.

13. The method according to claim 11 wherein the manually rotating step comprises rotation of the translatable and rotatable means together with the frame access gate in respect to the stationary portion of the frame.

14. A method of removing an artistic container, adapted to receive an audio recording therein, from a display frame comprising the steps of:

providing, as part of the display frame, a static frame portion comprising means for defining a visually open portion for exposing artwork on the container and a frame access gate which is connected to the static frame portion by translatable and rotatable corner connectors comprising means for translating and rotating the frame access gate, the corner connectors further comprising a means for manually releasibly maintaining the frame access gate in alignment with and out of alignment with the static frame means when the frame access gate is so disposed;

manually displacing by first translating and then rotating the frame access gate of the display frame and corner connectors away from and out of alignment with the remainder of the display frame to an open independently stable position maintained by manually releasible access gate position maintaining means thereby exposing part of the container;

manually grasping the exposed part of the container while disposed at the visually open portion where the artwork thereof is exposed to view and removing the container by rectilinear translation from the display frame;

causing the frame access gate and corner connectors to be first rotated and then translated toward the remainder of the frame to a closed independently stable position of the display frame and thereat maintained by the manually releasible access gate position maintaining means.

15. The method according to claim 14 further comprising practicing the following step prior to the causing step:

manually rectilinearly inserting a second artistic container into the interior of the open, empty display frame so that artwork thereof is visually exposed at a front of the display frame.

16. Display structure comprising:

visual display means comprising a facing side for displaying a visual display to view and a perimeter around the facing side;

display frame means sized and shaped to generally surround the perimeter of the facing side when the visual display means are placed therein, the display frame means comprising movable access gate means comprising two ends and static frame means, the access gate means comprising corner connector means for connecting the respective ends of the access gate means to the static frame means by which the access gate means are manually rectilinearly translated away from and rotated out of alignment with the static frame means for selective ingress and egress of the visual display means;

said corner connector means comprising first position and second position attaining and maintaining means further comprising translation means whereby the access gate means are linearly, slidably displaced from the first position, where the access gate means are juxtaposed against the static frame means, and held from rotation until the access frame is disposed a predetermined distance from the static frame means, hinge means about which the frame access means are returnably rotated from alignment with the static frame means to the second position, and means for manually releasibly maintaining the static frame means in each first and second position;

the display frame means further comprising means for defining a front for exposing to view the visual display when the visual display means are disposed within the display frame means.

17. A method of displaying a visual display article, comprising the steps of:

providing a display frame comprising means for defining a visually open front through which the visual display article is visually exposed, a stationary portion of the frame and a frame access gate which comprises corner connector means for translatably and rotatably connecting the frame access gate to the stationary frame, the corner connector means further comprising a means for manually releasibly holding the frame access gate in alignment with and out of alignment with the stationary portion of the frame when the frame access gate is so disposed;

manually translating the frame access gate of the display frame away from the stationary portion of the frame so that hinge sites of the translatable and rotatable connecting means interposed between the access gate and the remainder of the frame are likewise translated and thereafter manually rotating the access gate and part of each corner connector about the hinge sites while the hinge sites remain in a fixed location thereby causing the access gate to be disposed and held in an open self-sustaining biased stable position out of alignment with the remainder of the frame by the holding means;

manually placing the visual display article into an interior of the open display frame so that the visual display article is visually exposed at the front of the display frame;

causing the frame access gate to be displaced toward the remainder of the frame to a closed self-sustaining position.

18. A method of removing a visual display article from a display frame, comprising an interior for holding at least one visual display article, a display face for exposing a visual display of the visual display article, a frame access gate which is a translatable and rotatable part of the frame, a remainder of the frame which is stationary relative to the translation and rotation of the frame access gate, and corner connectors which provide selectively slidable and rotatable connection of the frame access gate to the remainder of the frame and which, manually releasibly maintain the frame access gate in alignment with and out of alignment with the remainder of the frame when the frame access gate is so disposed, said method comprising the steps of manually translating and thereafter rotating a frame access gate of the display frame away from the remainder of the display frame to an open stable released position maintained by the corner connectors while retaining the selectively slidable and rotatable corner connectors only between the frame access gate from the remainder of the display frame to misalign the access gate in respect to the remainder of the frame thereby opening the display frame and exposing part of the visual display article;

manually grasping the exposed part of the visual display article while the visual display article is in a position where at least part of the visual display is exposed at the display face and removing the visual display article from the display frame;

causing the frame access gate to be displaced toward the remainder of the frame to a closed stable released position of the display frame which is also maintained by the corner connectors.

19. The method according to claim 18 further comprising practicing the following step prior to the causing step:

manually inserting a second visual display article into the interior of the open display frame so that the second visual display article is visually exposed at the front of the display frame.

20. A method of assembling an access gate for a picture or like frame which provides a stable self-retaining closed position for storage of a visual frame insert such that a display of the insert is exposed to view and at least one stable open self-retaining position which provides egress and ingress for said insert, said method comprising the steps of:

providing the access gate and three linear frame edge members, the access gate and three linear frame edge members, in combination, forming the periphery of the frame having a hollow interior for receiving the visual frame insert so as to expose the display to view;

rigidly connecting the three linear frame edge members together at two corners leaving two end corner sites free for connection to the access gate;

rigidly connecting a slidable and hinged corner connector to each end of the access gate;

rigidly and slidably connecting one slidable and hinged corner connector to each of the two end corner sites;

attaching one end of a biasing member to each slidable and hinged corner connector and attaching the other end of the biasing member to a fixed position of the associated corner site at each end of the access gate;

opening the access gate from a self-retaining closed position by first linearly extending the access gate from the remainder of the frame counter to bias of the biasing member and then rotating the access gate out of alignment with a plane containing the connected three linear frame edge members to a stable position maintained by the biasing member for respectively inserting and removing the visual frame insert to and from the display exposing position within the hollow interior;

closing the access gate from the stable self-retaining open position by manually counter-rotating the access gate into alignment with the connected three linear frame edge members and allowing the bias of the biasing member to position the ends of the access gate against the two corner sites.

* * * * *